United States Patent [19]

Mihayashi et al.

[11] Patent Number: 4,705,743

[45] Date of Patent: Nov. 10, 1987

[54] SILVER HALIDE COLOR PHOTOGRAPHIC LIGHT-SENSITIVE MATERIAL

[75] Inventors: Keiji Mihayashi; Shunji Takada, both of Kanagawa, Japan

[73] Assignee: Fuji Photo Film Co. Ltd., Kanagawa, Japan

[21] Appl. No.: 681,032

[22] Filed: Dec. 12, 1984

[30] Foreign Application Priority Data

Dec. 12, 1983 [JP] Japan ..... 58-233845

[51] Int. Cl.[4] ..... G03C 1/40; G03C 7/34; G03C 7/36; G03C 7/38

[52] U.S. Cl. ..... 430/385; 430/505; 430/553; 430/555; 430/557; 430/558; 430/567

[58] Field of Search ..... 430/543, 553, 555, 557, 430/558, 567, 505, 385, 504

[56] References Cited

U.S. PATENT DOCUMENTS 3,733,201 5/1973 Barr et al. ..... 430/387
4,310,623 1/1982 Watanabe et al. ..... 430/505
4,366,237 12/1982 Ichijima et al. ..... 430/555
4,420,556 12/1983 Booms et al. ..... 430/549
4,489,155 12/1984 Sakonoue et al. ..... 430/505

*Primary Examiner*—Richard L. Schilling
*Attorney, Agent, or Firm*—Sughrue, Mion, Zinn, Macpeak & Seas

[57] ABSTRACT

A silver halide color photographic light-sensitive material comprising a support having thereon at least one silver halide emulsion layer, wherein the photographic light-sensitive material has a layer containing both a non-diffusible coupler capable of producing a dye of such mobilitly that controlled image smearing occurs upon reaction with the oxidation product of a color developing agent and a silver halide emulsion in which silver halide grains containing at least about 8 mol % of silver iodide grains account for at least about 40% by weight of the total silver halide grains in the emulsion. The silver halide color photographic light-sensitive material has improved RMS graininess as well as improved visual graininess.

12 Claims, No Drawings

SILVER HALIDE COLOR PHOTOGRAPHIC LIGHT-SENSITIVE MATERIAL

FIELD OF THE INVENTION

The present invention relates to a silver halide color photographic material and more particularly to a silver halide color photographic light-sensitive material for photographing having improved graininess.

BACKGROUND OF THE INVENTION

The recent popularity of the 110 format camera and disc camera require that color prints obtained by enlarging a small-disc image have graininess and a degree of resolution comparable to those using a large-sized image.

Two methods of improving graininess are described in T. H. James, ed., *The Theory of the Photographic Process*, page 621 (4th ed., 1977, MacMillan). One of the procedures increases the number of developing sites in silver halide grains and further controls the amount of a dye formed. The other procedure makes a dye cloud formed by color development indefinite. Increasing the number of silver halide grains while maintaining a given photographic sensitivity is accompanied by an increase in the amount of silver to be coated and thus by a deterioration in the degree of resolution. The first procedure, therefore, is disadvantageous from the viewpoints of production costs and photographic performance. An attempt to improve graininess through diffusion of a dye uses a dye diffusible type coupler, as described in Japanese Patent Application (OPI) No. 82837/82 (the term "OPI" as used herein means a "published unexamined Japanese patent application"). In this procedure, however, the color print is visually unsatisfactory, as will be described later in detail, although the RMS (root mean square) graininess is improved.

As a result of investigations to improve graininess, it has been found that if a non-diffusible type coupler capable of producing a dye of such mobility that controlled image smearing occurs on reacting with an oxidation product of a developing agent (which is hereinafter referred to as "smearing dye-producing coupler") is used to improve graininess, the RMS graininess (which is described at page 619 of the above-described James reference) is greatly improved. In this case, however, since the arrangement of silver halide grains and development probability occur in varied steps, the dye diffuses and then intermingles with an adjacent dye. This increases the overlapping of dye clouds, resulting in the formation of gigantic dye clouds at random. The formation of such gigantic dye clouds is visually very unpleasant, and in some cases, the color print looks as if the graininess were deteriorated.

SUMMARY OF THE INVENTION

An object of the present invention is to provide a silver halide color photographic light-sensitive material having improved visual graininess.

Another object of the present invention is to provide a silver halide color photographic light-sensitive material having both improved visual graininess and RMS graininess.

These objects of the present invention can be attained by a silver halide color photographic light-sensitive material comprising a support having thereon at least one silver halide emulsion layer, wherein the photographic light-sensitive material has a layer containing both a non-diffusible coupler capable of producing a dye of such mobility that controlled image smearing occurs upon reaction with the oxidation product of a color developing agent and a silver halide emulsion in which silver halide grains containing at least about 8 mol % of silver iodide grains account for at least about 40% by weight of the total silver halide grains in the emulsion. This silver halide emulsion is hereinafter referred to a "high iodine content silver halide emulsion".

DETAILED DESCRIPTION OF THE INVENTION

Although the mechanism for improvement of both visual graininess and RMS graininess through incorporation of a smearing dye-producing coupler and a high iodine content silver halide emulsion in the same layer is not fully understood, it is believed that the improvement is attained as follows.

If a smearing dye-producing coupler is used in combination with a low or intermediate iodine content silver halide as commonly used, the dye diffuses while the amount of the dye in each dye cloud remains unchanged. As a result, the density of dye in the dye cloud is decreased in one area of density and increased in another area. This dye cloud is hereinafter referred to as a "smearing type dye cloud", and if graininess is represented in terms of RMS values, it has an improved value. As described above, however, such dye clouds become larger and overlap each other, and the color print is visually very unsatisfactory and is poor in graininess.

As earlier indicated, it is necessary per the present invention that the dye released by the non-diffusible coupler have diffusibility to the extent that it exhibits controlled smearing but it does not diffuse to a different layer.

Thus, the present invention is quite different from photographic elements as are disclosed in U.S. Pat. No. 3,733,201 Barr et al where the dyes disclosed always contain an acidic solubilizing radical, as is mandated by the definition of SOL in Barr et al. Due to this radical, the dye formed per Barr et al dissolves in an alkaline developing solution which is used, i.e., a receiving layer and a mordant layer are essential in Barr et al and it is, accordingly, always the case that the dye formed per Barr et al does not remain in the emulsion layer in which the coupler was present. The situation per the present invention is directly contrary. This is a consequence of the fact that the coupler of the present invention is such that the dye formed remains in the emulsion layer and the dye formed does not have an acidic solubilizing radical, whereby a dye which dissolves in an alkaline developing solution to any substantial extent does not result.

If, on the other hand, a high iodine content silver halide emulsion is used in a system as described above, iodine ions are formed as the development proceeds, thereby decreasing the size of the cloud derived from the smearing dye-producing coupler, by a development-inhibiting action and, furthermore, inhibiting development of silver halide emulsion grains adjacent to those grains which have been developed to a certain extent. As a result, overlapping of dye clouds is reduced and visually large mottles cannot be seen readily. Thus, the disadvantage of smearing dye-producing couplers of poor visual graininess is improved.

A specific combination of a smearing dye-producing coupler and an high iodine content silver halide emulsion according to the present invention provides a silver halide color photographic light-sensitive material which is greatly improved not only in graininess exposed in terms of an RMS value but also in visual graininess.

The effect of the present invention of improving visual graininess can be obtained by incorporating the smearing dye-producing coupler/high iodine content silver halide emulsion combination into any color image-forming unit of a color photographic light-sensitive material. In a light-sensitive material including a plurality of emulsion layers sensitive to varied regions of the visible spectrum, the combination can be added to one or more layers sensitive to any desired color. Even in the usual color light-sensitive material comprising a blue-sensitive layer, a green-sensitive layer, and a red-sensitive layer, the combination can be added to one or more layers. Preferably the combination is used in a green-sensitive layer in which magenta color of high visual sensitivity is formed, since the visual graininess is greatly improved. If a plurality of silver halide emulsion layers having varied sensitivities are provided in the same color-sensitive region, the combination of the present invention can be used in a layer having any desired sensitivity. Preferably the combination is added to a layer of high sensitivity where graininess is most noticeable, since the visual graininess is greatly improved.

The smearing dye-producing couplers used in the present invention include those compounds represented by the following general formula (A):

$$(Cp)_a X \qquad (A)$$

wherein Cp represents a coupler component which yields a dye of such mobility that controlled image smearing occurs and improves graininess; X represents a component which is bonded to the coupling position of the coupler component, which is released upon a reaction with an oxidation product of a color developing agent and which contains a ballast group having from 8 to 32 carbon atoms; and a represents 1 or 2.

Of such couplers represented by general formula (A), preferred couplers are represented by the following general formulae (I), (II) and (III):

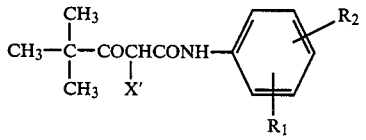

(I)

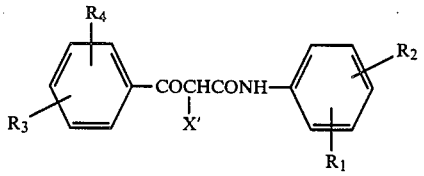

(II)

-continued

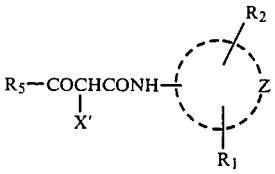

(III)

wherein $R_1$, $R_2$, $R_3$ and $R_4$, which may be the same or different, each represents a hydrogen atom, a halogen atom, an alkyl group (e.g., a methyl group, an ethyl group, an isopropyl group, a hydroxyethyl group, etc.), an alkoxy group (e.g., a methoxy group, an ethoxy group, a methoxyethoxy group, etc.), an aryloxy group (e.g., a phenoxy group, etc.), an acylamino group (e.g., an acetylamino group, a trifluoroacetylamino group, etc.), a sulfonamino group (e.g., a methanesulfonamino group, a benzenesulfonamino group, etc.), a carbamoyl group, a sulfamoyl group, an alkylthio group, an alkylsulfonyl group, an alkoxycarbonyl group, a ureido group, a cyano group, a carboxyl group, a hydroxy group, or a sulfo group; $R_5$ represents an alkyl group (e.g., a methyl group, an ethyl group, a tert-butyl group, etc.), an aryl group (e.g., a phenyl group, a 4-methoxyphenyl group, etc.) or an alkoxy group (e.g., a methoxy group, an ethoxy group, etc.), provided that the total number of carbon atoms included in $R_1$, $R_2$, $R_3$, $R_4$ and $R_5$ is not more than 10; Z represents a non-metal atomic group necessary to form a heterocyclic group (e.g., a 2-pyridyl group, a 4-pyridyl group, a 2-quinolyl group, etc.); and X' represents a group which contains a so-called ballast group having from 8 to 32 carbon atoms, providing non-diffusibility to the coupler, and which is capable of being released upon a coupling reaction with an oxidation product of an aromatic primary amine developing agent.

In more detail, the group represented by X' is an acyloxy group, a sulfonyloxy group, a sulfinyloxy group, a sulfamoyloxy group, a carbamoyloxy group, a thiocarbamoyloxy group, an oxamoyloxy group or a group represented by the following general formula (IV) or (V):

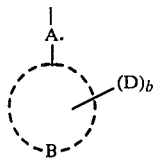

(IV)

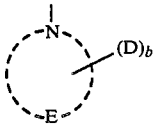

(V)

wherein A represents an oxygen atom or a sulfur atom; B represents a non-metal atomic group necessary to form an aryl ring or a heterocyclic ring; and E represents a non-metal atomic group necessary to form a 5-membered or 6-membered heterocyclic ring together with the nitrogen atom; these rings may be further condensed with an aryl ring or a heterocyclic ring; D represents a ballast group; and b represents a positive integer, when b is two or more, Ds may be the same or different, and the total number of carbon atoms included is from 8 to 32. D may be bonded to the condensed ring to the group of

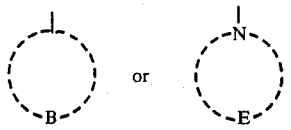

D may contain a connecting group, e.g., —O—, —S—, —COO—, —CONH—, —$SO_2$NH—, —NHCONH—, —$SO_2$—, —CO—,

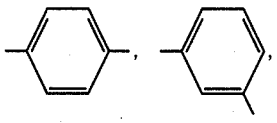

—NH—, etc.

Of the couplers represented by the general formula (A), other preferred couplers are represented by the following general formulae (VI), (VII), (VIII) and (IX):

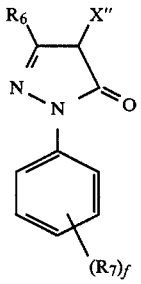

(VI)

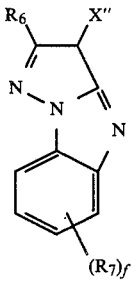

(VII)

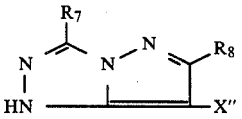

(VIII)

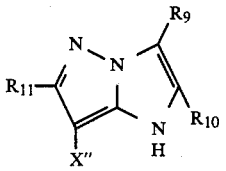

(IX)

wherein $R_6$ represents an acylamino group (e.g., a propanamido group, a benzamido group, etc.), an anilino group (e.g., a 2-chloroanilino group, a 5-acetamidoanilino group, etc.), or a ureido group (e.g., a phenylureido group, a butaneureido group, etc.); $R_7$ and $R_8$ each represents a halogen atom, an alkyl group (e.g., a methyl group, an ethyl group, etc.), an alkoxy group (e.g., a methoxy group, an ethoxy group, etc.), an acylamino group (e.g., an acetamido group, a benzamido group, etc.), an alkoxycarbonyl group (e.g., a methoxycarbonyl group, etc.), an N-alkylcarbamoyl group (e.g., an N-methylcarbamoyl group, etc.), a ureido group (e.g., an N-methylureido group, etc.), a cyano group, an aryl group (e.g., a phenyl group, a naphthyl group, etc.), an N,N-dialkylsulfamoyl group, a nitro group, a hydroxy group, a carboxyl group, an aryloxy group, etc.; f represents an integer of from 0 to 4, when f is 2 or more, $R_7$ may be the same or different; $R_9$, $R_{10}$ and $R_{11}$ each represents a hydrogen atom, an alkyl group (e.g., a methyl group, a propyl group, a cyclohexyl group, etc.), an aryl group (e.g., a phenyl group, a 3-acetamidophenyl group, etc.), a heterocyclic group (e.g., an imidazolyl group, a furyl group, etc.), a cyano group, an alkoxy group (e.g., an ethoxy group, a benzyloxy group, etc.), an aryloxy group (e.g, a phenoxy group, etc.), an acylamino group (e.g., a butanamido group, an octanamido group, etc.), an anilino group (e.g., a 2-chloroanilino group, a 4-methoxyanilino group, etc.), a ureido group (e.g., a phenylureido group, etc.), a sulfamoylamino group (e.g., an N,N-diisopropylsulfamoylamino group, etc.), an alkylthio group (e.g., an octylthio group, etc.), an arylthio group (e.g., a phenylthio group, etc.), an alkoxycarbonyl group (e.g., an ethoxycarbonyl group, etc.), an alkoxycarbonylamino group (e.g., a benzyloxycarbonylamino group, etc.), a sulfonamido group (e.g., a methanesulfonamido group, etc.), a carbamoyl group (e.g., an N,N-dibutylcarbamoyl group, etc.), a sulfamoyl group (e.g., an N,N-diethylsulfamoyl group, etc.), or a sulfonyl group (e.g., a methanesulfonyl group, etc.), provided that the total number of carbon atoms included in $R_6$ and $(R_7)_f$ of the general formulae (VI) and (VII), in $R_7$ and $R_8$ of the general formula (VIII) or in $R_9$, $R_{10}$ and $R_{11}$ of the general formula (IX) is not more than 10; and X″ represents a group which is bonded to the coupling position through an oxygen atom, a nitrogen atom or a sulfur atom and which is capable of being released upon a coupling reaction.

In more detail, the group represented by X″ is a group represented by the following general formula (X), (XI), (XII), (XIII) or (XIV):

—S—$R_{12}$ (X)

—O—$R_{12}$ (XI)

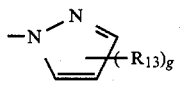

(XII)

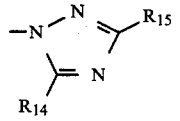

(XIII)

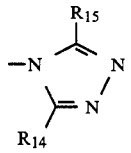

(XIV)

wherein $R_{12}$ represents an aliphatic group, an aromatic group or a heterocyclic group; g represents an integer of 1 to 3; $R_{13}$ represents a hydrogen atom, a halogen atom (e.g., a chlorine atom, etc.), an acylamino group (e.g., a tetradecanamido group, a 2-(2,4-di-tert-amylphenoxy)butanamido group, etc.), an alkoxy group (e.g., a dodecyloxy group, etc.), an alkoxycarbonyl group (e.g., a dodecyloxycarbonyl group, etc.), a sulfamoyl group (e.g., an N-dodecylsulfamoyl group, etc.), a sulfonamido group (e.g., a hexadecylsulfonylamino group, etc.), a carbamoyl group (e.g., an N-dodecylcarbamoyl group, etc.), an amido group (e.g., an octadecenylsuccinimido group, etc.), an aliphatic group, an aromatic group or a heterocyclic group, when g is two or more, $R_{13}$ may be the same or different; and $R_{14}$ and $R_{15}$ each has the same meaning as defined for $R_{13}$.

Where $R_{12}$, $R_{13}$, $R_{14}$ or $R_{15}$ represents an aromatic group (particularly, a phenyl group), the aromatic group may be substituted with an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, or an alkyl substituted succinimido group, etc. In such a case the alkyl moiety may contain an aromatic group such as a phenylene group in its chain. Also, the phenyl group represented by $R_{12}$, $R_{13}$, $R_{14}$ or $R_{15}$ may be substituted with an aryloxy group, an aryloxycarbonyl group, an arylcarbamoyl group, an arylamido group, an arylsulfamoyl group, an arylsulfonamido group or an arylureido group, etc. and the aryl moiety in these substituents may further substituted with an alkyl group. Further, the phenyl group represented by $R_{12}$, $R_{13}$, $R_{14}$ or $R_{15}$ may be substituted with an amino group, a hydroxy group, a carboxy group, a sulfo group, a nitro group, an alkoxy group, a cyano group, a thiocyano group or a halogen atom.

Where $R_{12}$, $R_{13}$, $R_{14}$ or $R_{15}$ represents an aliphatic group, the aliphatic group may be substituted or unsubstituted, chain or cyclic, or saturated or unsaturated. Preferred examples of the substituents for the alkyl group include an alkoxy group, an aryloxy group, an amino group, an acylamino group, a halogen atom, an aryl group, an alkoxycarbonyl group, a sulfonamido group, a sulfamoyl group, an alkylthio group, a carboxy group, an alkylsulfonyl group, an imido group, an alkanoyloxy group, an arylcarbonyloxy group, etc., and these groups per se may further be substituted.

When $R_{12}$, $R_{13}$, $R_{14}$ and $R_{15}$ represents a heterocyclic group, examples of the heterocyclic ring include thiophene, furan, pyran, pyrrole, pyrazole, pyridine, pyrazine, pyrimidine, pyridazine, indolizine, imidazole, thiazole, oxazole, triazine, thiadiazine, oxazine, tetrazole, benzimidazole, etc. The heterocyclic group may be substituted with a substituent as defined for the aromatic group or the aliphatic group described above.

The total number of carbon atoms included in $R_{12}$ of the general formulae (X) and (XI), in $(R_{13})_g$ of the general formula (XII) or in $R_{14}$ and $R_{15}$ of the general formulae (XIII) and (XIV) is from 8 to 32.

Of the couplers represented by the general formula (A), other preferred couplers are represented by the following general formulae (XV) and (XVI):

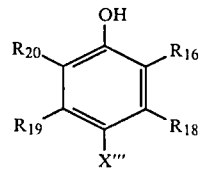
(XV)

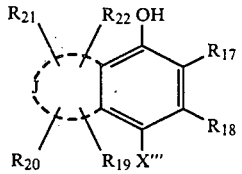
(XVI)

wherein $R_{16}$ represents a hydrogen atom, an aliphatic group having 10 or less carbon atoms (e.g., an alkyl group such as a methyl group, an isopropyl group, a cyclohexyl group, an octyl group, etc.), an alkoxy group having 10 or less carbon atoms (e.g., a methoxy group, an isopropoxy group, a pentyloxy group, etc.), an aryloxy group (e.g., a phenoxy group, a p-tert-butylphenoxy group, etc.), an acylamido group, a sulfonamido group and a ureido group represented by the general formulae (XVII) to (XIX) as described below, or a carbamoyl group represented by the general formula (XX) as described below.

$$-NH-CO-G \quad \text{(XVII)}$$

$$-NH-SO_2-G \quad \text{(XVIII)}$$

$$-NHCONH-G \quad \text{(XIX)}$$

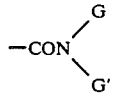
(XX)

wherein G and G', which may be the same or different, each represents a hydrogen atom (provided that G and G' are not hydrogen atoms at the same time and that the total number of carbon atoms included in G and G' is from 1 to 12), an aliphatic group having from 1 to 12 carbon atoms, preferably a straight chain or branched chain alkyl group having from 4 to 10 carbon atoms or a cyclic alkyl group having less than 10 carbon atoms (e.g., a cyclopropyl group, a cyclohexyl group, a norbornyl group, etc.), an aryl group (e.g., a phenyl group, a naphthyl group, etc.) or a heterocyclic group (e.g., a benzothiazolyl group, etc.), and the alkyl, aryl and heterocyclic groups may be substituted with a halogen atom (e.g., a fluorine atom, a chlorine atom, etc.), a nitro group, a cyano group, a hydroxy group, a carboxy group, an amino group (e.g., an amino group, an alkylamino group, a dialkylamino group, an anilino group, an N-alkylanilino group, etc.), an alkyl group (e.g., those as described above), an aryl group (e.g., a phenyl group, an acetylaminophenyl group, etc.), an alkoxycarbonyl group (e.g., a butyloxycarbonyl group, etc.), an acyloxycarbonyl group, an amido group (e.g., an acetamido group, a methanesulfonamido group, etc.), an imido group (e.g., a succinimido group, etc.), a carbamoyl group (e.g., an N,N-diethylcarbamoyl group, etc.), a sulfamoyl group (e.g., an N,N-diethylsulfamoyl group, etc.), an alkoxy group (e.g., an ethoxy group, a butyloxy group, an octyloxy group, etc.), an aryloxy group (e.g., a phenoxy group, a methylphenoxy group, etc.), a sulfonyl group (e.g., a propylsulfonyl group, a phenylsulfonyl group, etc.), etc. $R_{16}$ may contain commonly used substituents in addition to the above-described substituents.

$R_{17}$ represents a hydrogen atom, an aliphatic group having 12 or less carbon atoms, preferably an alkyl group having from 1 to 10 carbon atoms, or a carbamoyl group represented by the general formula (XX) described above.

$R_{18}$, $R_{19}$, $R_{20}$, $R_{21}$ and $R_{22}$ each represents a hydrogen atom, a halogen atom, an alkyl group, an aryl group, an alkoxy group, an alkylthio group, a heterocyclic group, an amino group, a carbonamido group, a sulfonamido group, a sulfamyl group or a carbamyl group.

In greater detail, $R_{18}$ represents a hydrogen atom, a halogen atom (e.g., a chlorine atom, a bromine atom, etc.), a primary, secondary or tertiary alkyl group having from 1 to 12 carbon atoms (e.g., a methyl group, a propyl group, an isopropyl group, a n-butyl group, a sec-butyl group, a tert-butyl group, a hexyl group, a dodecyl group, a 2-chlorobutyl group, a 2-hydroxyethyl group, a 2-phenylethyl group, a 2-(2,4,6-trichlorophenyl)-ethyl group, a 2-aminoethyl group, etc.), an alkylthio group (e.g., an octylthio group, etc.), an aryl group (e.g., a phenyl group, a 4-methylphenyl group, a 2,4,6-trichlorophenyl group, a 3,5-dibromophenyl group, a 4-trifluoromethylphenyl group, a 2-trifluoromethylphenyl group, a 3-trifluoromethylphenyl group, a naphthyl group, a 2-chloronaphthyl group, a 3-ethylnaphthyl group, etc.), a heterocyclic group (e.g., a benzofuranyl group, a furyl group, a thiazolyl group, a benzothiazolyl group, a naphthothiazolyl group, an oxazolyl group, a benzoxazolyl group, a naphthoxazolyl group, a pyridyl group, a quinolinyl group, etc.), an amino group (e.g., an amino group, a methylamino group, a diethylamino group, a dodecylamino group, a phenylamino group, a tolylamino group, a 4-cyanophenylamino group, a 2-trifluoromethylphenylamino group, a benzothiazolylamino group, etc.), a carbonamido group (e.g., an alkylcarbonamido group such as an ethylcarbonamido group, a decylcarbonamido group, etc., an arylcarbonamido group such as a phenylcarbonamido group, a 2,4,6-trichlorophenylcarbonamido group, a 4-methylphenylcarbonamido group, a 2-ethoxyphenylcarbonamido group, a naphthylcarbonamido group, etc., a heterocyclic carbonamido group such as a thiazolylcarbonamido group, a benzothiazolylcarbonamido group, a naphthothiazolylcarbonamido group, an oxazolylcarbonamido group, a benzoxazolylcarbonamido group, an imidazolylcarbonamido group, a benzimidazolylcarbonamido group, etc.), a sulfonamido group (e.g., an alkylsulfonamido group such as a butylsulfonamido group, a dodecylsulfonamido group, a phenylethylsulfonamido group, etc., an arylsulfonamido group such as a phenylsulfonamido group, a 2,4,6-trichlorophenylsulfonamido group, a 2-methoxyphenylsulfonamido group, a 3-carboxyphenylsulfonamido group, a naphthylsulfonamido group, etc., a heterocyclic sulfonamido group such as a thiazolylsulfonamido group, a benzothiazolylsulfonamido group, an imidazolylsulfonamido group, a benzimidazolylsulfonamido group, a pyridylsulfonamido group, etc.), a sulfamyl group (e.g., an alkylsulfamyl group such as a propylsulfamyl group, an octylsulfamyl group, etc., an arylsulfamyl group such as a phenylsulfamyl group, a 2,4,6-trichlorophenylsulfamyl group, a 2-methoxyphenylsulfamyl group, a naphthylsulfamyl group, etc., a heterocyclic sulfamyl group such as a thiazolylsulfamyl group, a benzothiazolylsulfamyl group, an oxazolylsulfamyl group, a benzimidazolylsulfamyl group, a pyridylsulfamyl group, etc.), or a carbamyl group (e.g., an alkylcarbamyl group such as an ethylcarbamyl group, an octylcarbamyl group, etc., an arylcarbamyl group such as a phenylcarbamyl group, a 2,4,6-trichlorophenylcarbamyl group, etc., a heterocyclic carbamyl group such as a thiazolylcarbamyl group, a benzothiazolylcarbamyl group, an oxazolylcarbamyl group, an imidazolylcarbamyl group, a benzimidazolylcarbamyl group, etc.).

$R_{19}$, $R_{20}$, $R_{21}$ and $R_{22}$ can also represent in detail those described in detail for $R_{18}$.

J represents a non-metal atomic group necessary to form a 5-membered or 6-membered ring, e.g., a benzene ring, a cyclohexene ring, a cyclopentene ring, a thiazole ring, an oxazole ring, an imidazole ring, a pyridine ring, a pyrrole ring, etc. Of these rings, a benzene ring is preferred.

X''' represents a group which contains a group having from 8 to 32 carbon atoms, which is bonded to the coupling position through —O—, —S—, or —N=N—, and which is capable of being released upon a coupling reaction with an oxidation product of an aromatic primary amine developing agent. Preferred examples are an alkoxy group, an aryloxy group, an alkylthio group, and an arylthio group, each having from 8 to 32 carbon atoms. These groups may further contain a divalent group such as —O—, —S—, —NH—, —CONH—, —COO—, —$SO_2$NH—, —SO—, —$SO_2$—, —CO—,

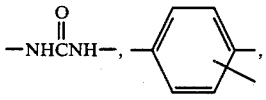

etc. Moreover, it is particularly preferred that these groups contain a group which is dissociated with alkali such as —COOH, —$SO_3$H, —OH and —$SO_2NH_2$, etc.

By suitably combining $R_{16}$, $R_{17}$, $R_{18}$, $R_{19}$, $R_{20}$, $R_{21}$, $R_{22}$ and X''', couplers can be made substantially diffusion-resistant.

Specific examples of the dye diffusible type couplers used in the present invention are set forth below, but the present invention should not be construed as being limited thereto.

Y-1

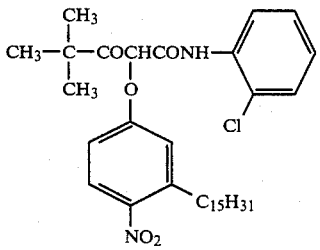

-continued
Y-2
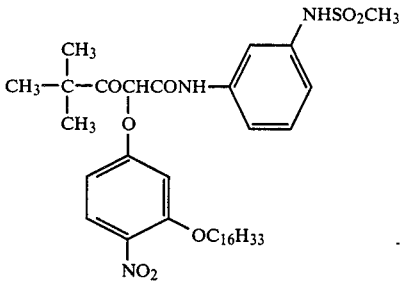
Y-3
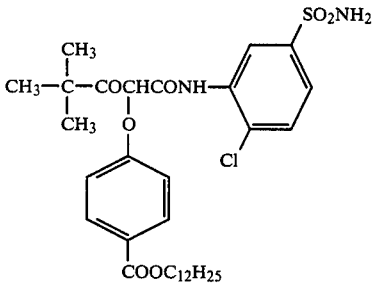
Y-4
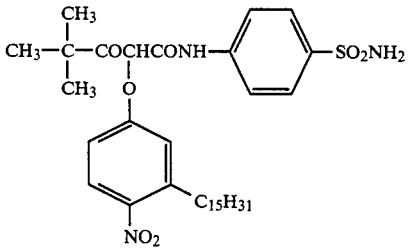
Y-5
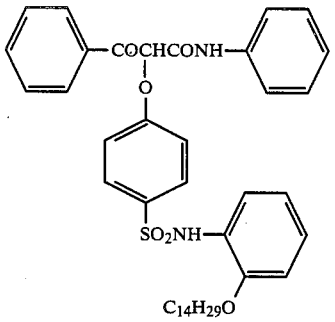
Y-6
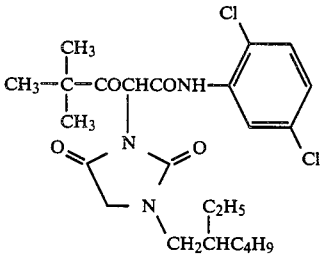
-continued
Y-7
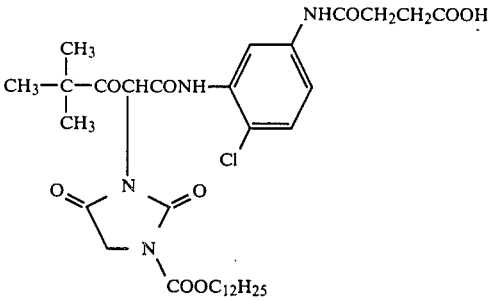
Y-8
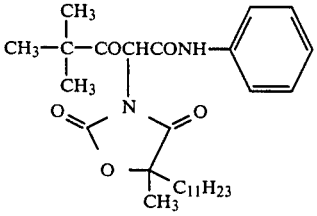
Y-9
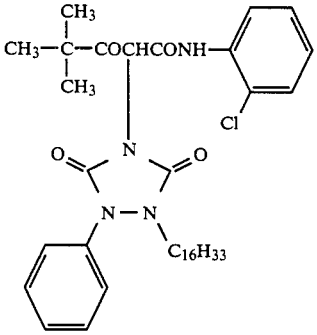
Y-10
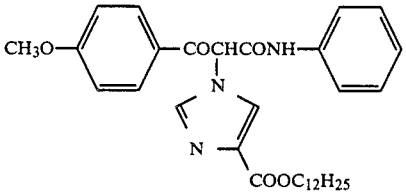
Y-11
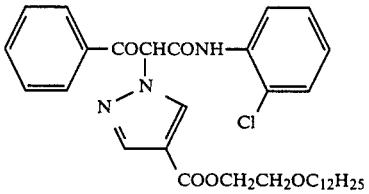
Y-12
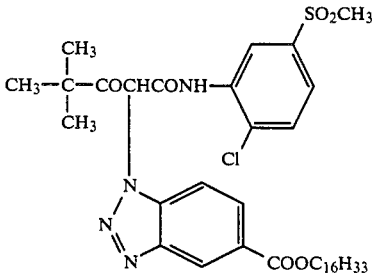

-continued
Y-13
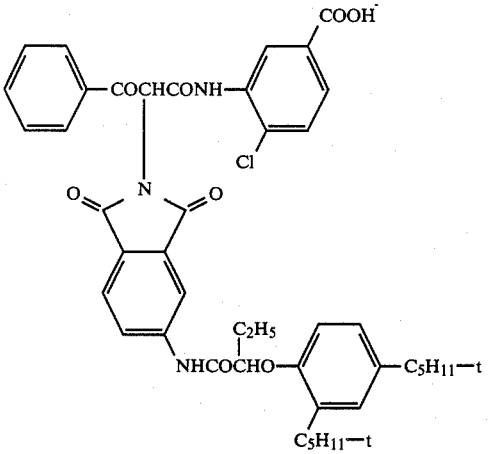
Y-14
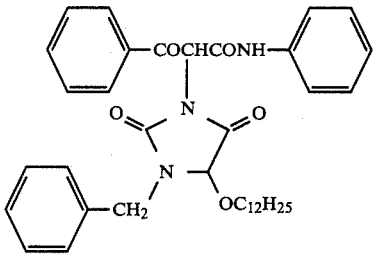
Y-15
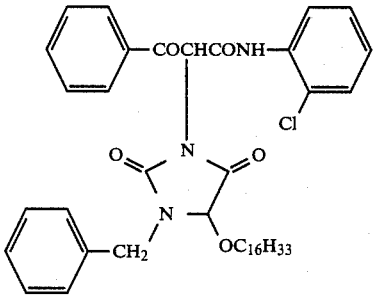
Y-16
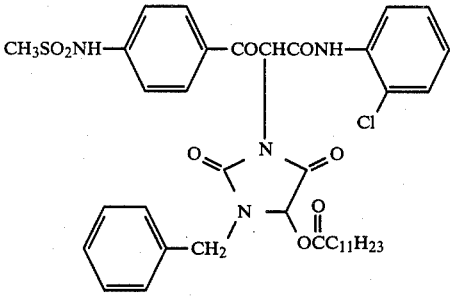
Y-17
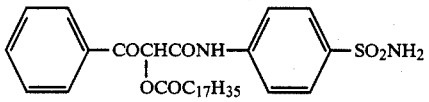
-continued
Y-18
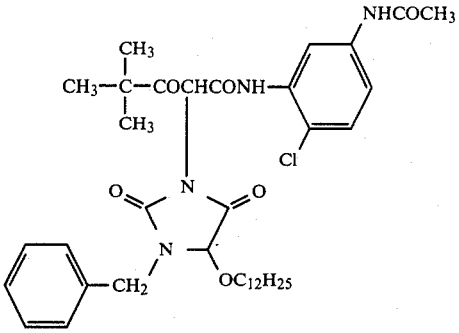
Y-19
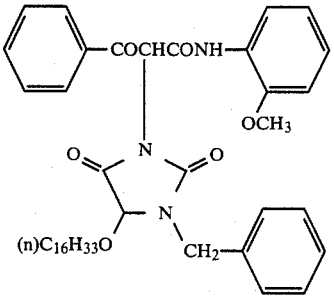
M-1
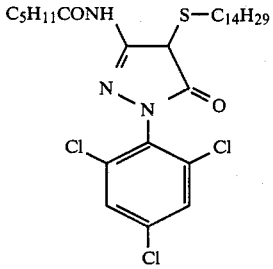
M-2
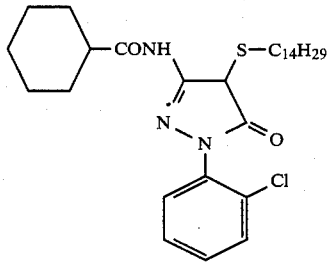
M-3
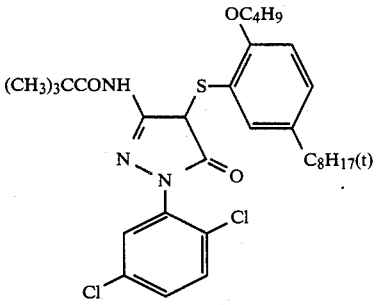

-continued
M-4
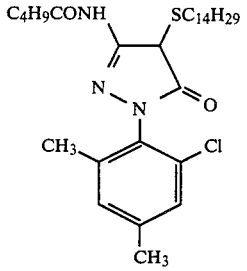
M-5
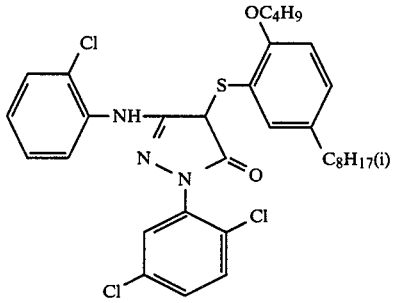
M-6
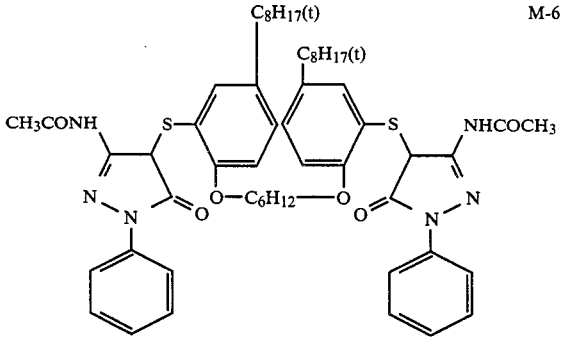
M-7
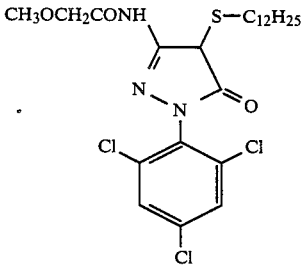
M-8
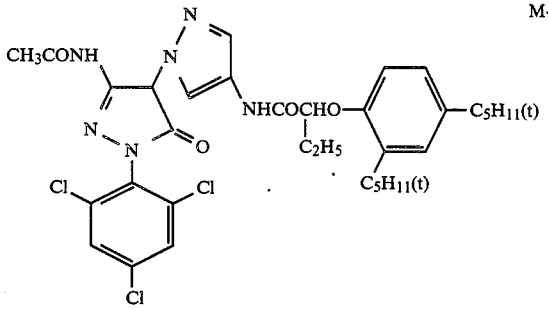
-continued
M-9
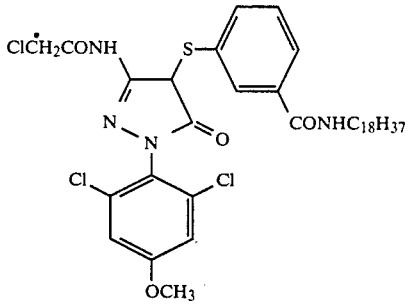
M-10
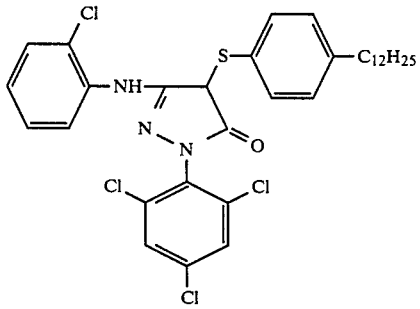
M-11
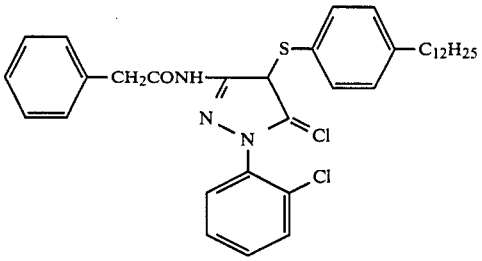
M-12
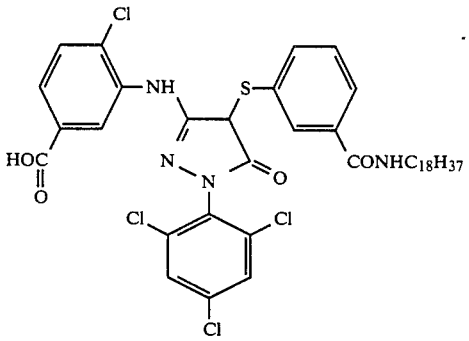
M-13
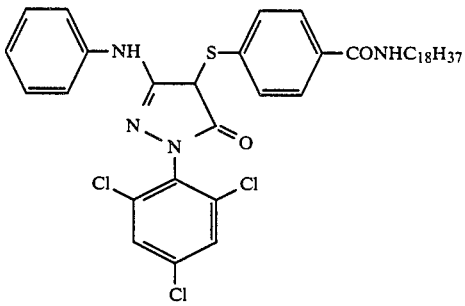

-continued
M-14
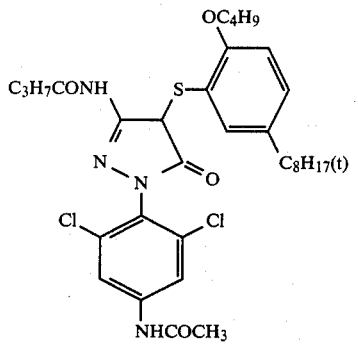
M-15
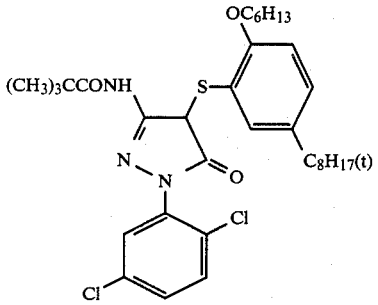
M-16
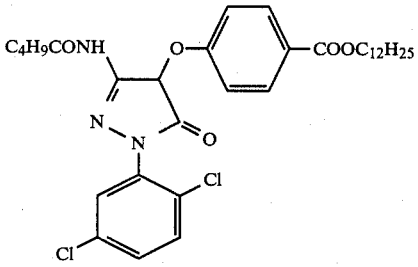
M-17
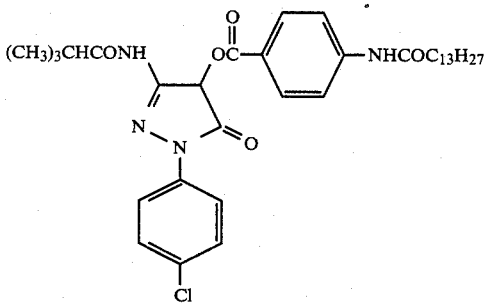
M-18
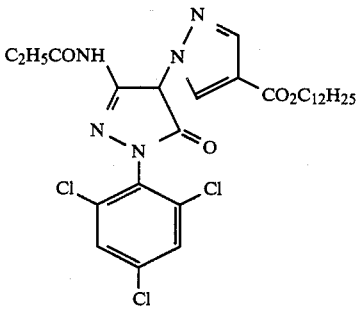
-continued
M-19
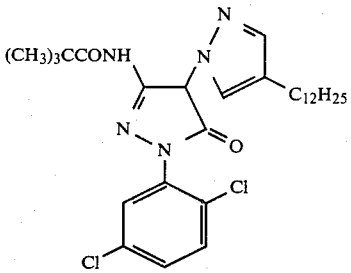
M-20
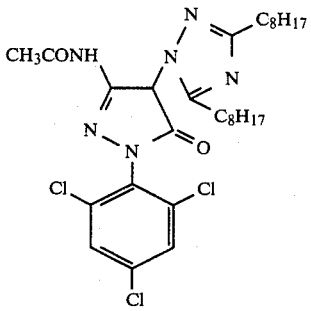
M-21
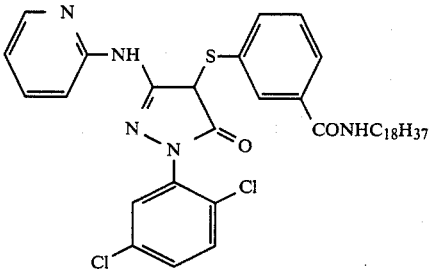
M-22
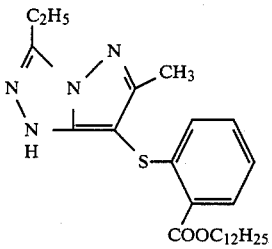
M-23
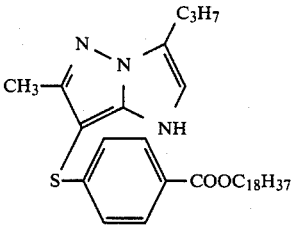
M-24
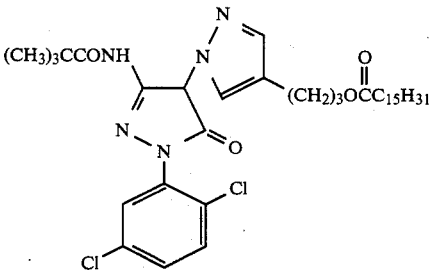

-continued
M-25
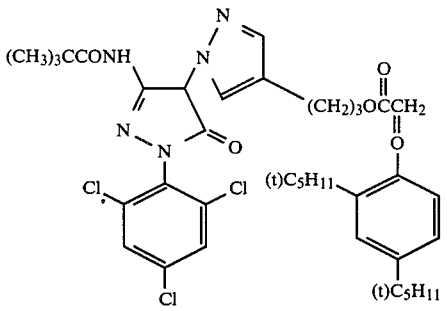
M-26
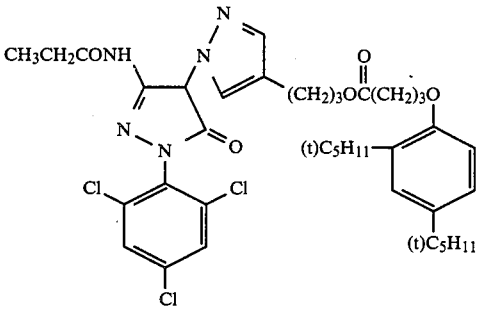
These compounds according to the present invention can be synthesized by methods as described, for example, in U.S. Pat. Nos. 4,264,723, 3,227,554, 4,310,619 and 4,301,235, Japanese Patent Application (OPI) Nos. 4044/82, 126833/81 and 122935/75, etc.
C-1
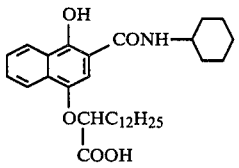
C-2
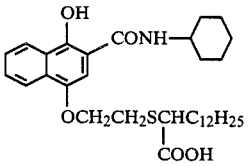
C-3
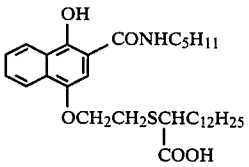
C-4
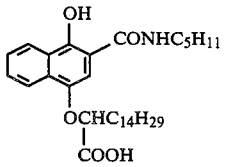
C-5
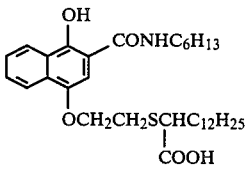
-continued
C-6
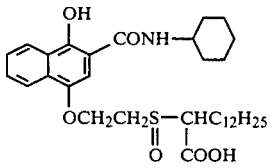
C-7
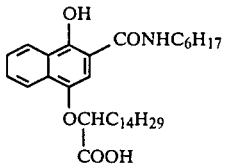
C-8
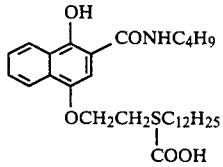
C-9
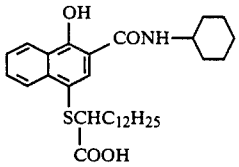
C-10
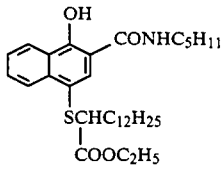
C-11
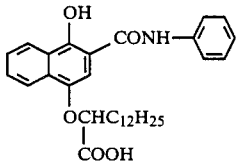
C-12
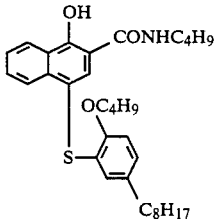
C-13
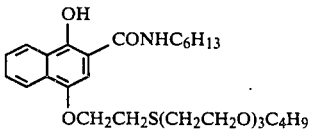
C-14
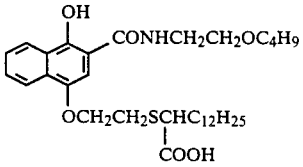

-continued

C-15

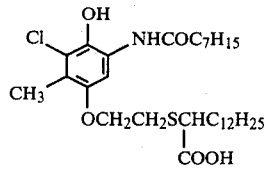

C-16

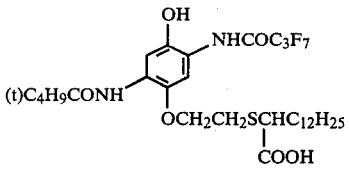

C-17

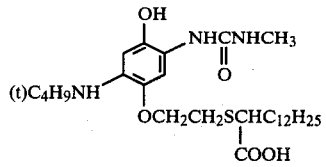

C-18

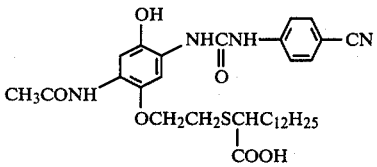

C-19

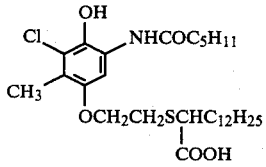

C-20

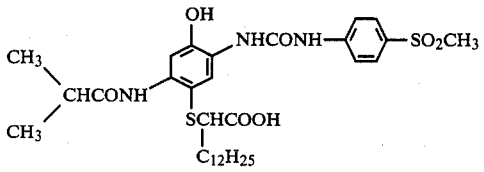

These compounds according to the present invention can be easily synthesized by methods as described, for example, in Japanese Patent Application (OPI) Nos. 1938/81, 3934/82 and 105226/78, etc.

Further, the smearing dye-producing couplers according to the present invention may be polymer couplers as described in Japanese Patent Application (OPI) No. 145944/83, etc.

The smearing dye-producing couplers according to the present invention may be couplers forming a dye having a development accelerating group or a fogging group as described in Japanese Patent Application No. 146097/83 (corresponding to U.S. patent application Ser. No. 639,294, filed Aug. 10, 1984).

It is preferred that the smearing dye-producing couplers which can be used in the present invention are those which have the molecular weight of about 250 to 700 after the formation of dyes in cases wherein the couplers do not have dissociation groups in their molecules, and those which have the molecular weight of about 450 to 1200 after the formation of dyes in cases wherein the couplers have one or more dissociation groups in their molecule. The term "dissociation group" as used herein means an acidic substituent which is dissociated at a rate of at least about 50% at the pH of the color developing solution used.

In the light-sensitive material of the present invention, two or more of the smearing dye-producing couplers may be added to the same layer, or the same compound may be added to two or more different layers. Furthermore, they may be used in combination with conventional non-diffusible type dye forming couplers.

The amount of the smearing dye-producing couplers used is from about $1\times10^{-3}$ to $1\times10^{-1}$ mole, preferably from about $3\times10^{-3}$ to $1\times10^{-1}$ mole, per mole of silver.

The silver halide emulsion that is used in the present invention is an emulsion in which silver halide grains containing at least about 8 mol% of silver iodide constitutes at least about 40% by weight, preferably at least about 60% by weight, and particularly preferably at least about 80% by weight of the total weight of all silver halide grains contained in a given silver halide emulsion layer.

Silver iodide may be distributed evenly or unevenly in silver halide grains. In the case of silver halide grains having a double-layer structure as described hereinafter, the average value of silver iodide in the grains is at least about 8 mol%.

The silver iodide content of each silver halide grain can be measured by an X-ray microanalyzer, for example. In accordance with this method, the weight ratio of silver halide grains containing at least about 8 mol% of silver iodide can be determined.

The upper limit of the iodine content of the high iodine content silver halide emulsion is determined by its solid solution critical value and is about 40 mol%. In the present invention, therefore, a silver halide emulsion having an iodine content falling within the range of from about 8 to about 40 mol%, preferably from about 10 to 30 mol%, and more preferably from about 12 to 25 mol% is used in combination with a smearing dye-producing coupler of the present invention. If the iodine content is below the lower limit, visual graininess is generally improved only slightly. On the other hand, if it is in excess of the upper limit, various problems occur, including a delay in development, low contrast, and insufficient desilvering.

In the high iodine content silver halide emulsion, the grain size is not critical; it is preferably at least about 0.8 μm and more preferably at least about 1.5 μm. If a high iodine content silver halide emulsion having a grain size falling within the above-specified range is used in combination with a smearing dye-producing coupler of the present invention, a color photographic light-sensitive material obtained having high sensitivity and improved graininess can be obtained.

The high iodine content silver halide emulsion as used herein can be prepared by various procedures, such as an acidic process, a neutral process, and an ammonia process. In reacting a soluble salt and a soluble halide, any of a single-jet process, a double-jet process, and a combination thereof can be employed. In addition, a process in which pAg is kept constant in a liquid phase where silver halide is formed, i.e., a controlled double-jet process, can be employed in a further embodiment of the double-jet process. In another embodiment, a triple-jet process in which soluble halides having different compositions (e.g., soluble silver salts, soluble bromides, and soluble iodides) are added independently can also be employed. In preparing an emulsion of relatively large size, it is preferred to use silver halide solvents such as ammonia, Rhodan salts, thioureas, and amines as described in James at page 9. It is well known in the art that preferred photographic properties are obtained by adjusting pH and pAg during the formation of grains. It is preferred that pH varies within the range of from about 2 to 10 depending on the process of preparation of grains.

The high iodine content silver halide emulsion of the present invention may have a regular crystal shape such as a cube, an octahedron, a dodecahedron, or a tetradecahedron, or it may have a spherical or tabular crystal form. The inner portion (core) and surface layer (shell) of emulsion grains may have different halogen compositions, or they may have the same halogen composition. Double-layer structure grains in which the core is made up of silver iodochlorobromide or silver iodobromide containing a high concentration of silver iodide and the shell is made up of silver chloroiodobromide or silver iodobromide having a low silver iodide content are preferably used in the emulsion of the present invention. The ratio of the amount of silver in the core to that in the shell can be chosen within a wide range but is preferably between about 5:1 and 1:5.

In double-layer structure grains, those silver halide emulsions in which the average silver iodide content of the grains is at least about 8 mol% can be used in the present invention. More specifically, the silver iodide content of the core is preferably at least about 15 mol%, more preferably at least about 25 mol%, and especially preferably from about 35 mol% to the silver iodobromide solid solution critical value (see page 4 of the above-cited James publication).

The silver iodide content of the shell is preferably adjusted to not more than about 5 mol%. More preferably, it is adjusted to not more than about 2 mol%.

In the course of the formation of silver halide grains or physical ripening, cadmium salts, zinc salts, lead salts, thallium salts, iridium salts or its complex salts, rhodium salts or its complex salts, iron salts or its complex salts, and the like may be present The emulsion, after the formation of precipitates or physical ripening, is usually freed of soluble salts. For this purpose, a noodle washing method can be used which has long been known and in which soluble salts are removed by gelating gelatin. In addition, a flocculation method utilizing inorganic salts composed of polyvalent anions, such as sodium sulfate, anionic surfactants, anionic polymers (e.g., polystyrenesulfonic acid), or gelatin derivatives (e.g., aliphatic acylated gelatin, aromatic acylated gelatin, and aromatic carbamoylated gelatin) can be employed.

Silver halide emulsions are usually chemically sensitized. For this chemical sensitization, for example, the methods as described in H. Frieser ed., *Die Grundlagen der Photographischen Prozesse mit Silberhalogeniden,* Akademische Verlagsgesselschaft, pages 675 to 734 (1968) can be used; sulfur sensitization using active gelatin or compounds (e.g., thiosulfates, thioureas, mercapto compounds, rhodanines, etc.) containing sulfur capable of reacting with silver, reduction sensitization using reducing substances (e.g., stannous salts, amines, hydrazine derivatives, formamidinesulfinic acid, silane compounds, etc.), noble metal sensitization using noble metal compounds (e.g., complex salts of Group VIII metals in the Periodic Table, such as Pt, Ir, Pd, etc., as well as gold complex salts), and so forth can be applied alone or in combination with each other.

Photographic emulsions used in the present invention may include various compounds for the purpose of preventing fog formation or of stabilizing photographic performance in the photographic light-sensitive material during the production, storage or photographic processing thereof. For example, those compounds known as antifoggants or stabilizers can be incorporated, including azoles such as benzothiazolium salts, nitroindazoles, triazoles, benzotriazoles, benzimidazoles (particularly nitro- or halogen-substituted compounds, etc.); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole), mercaptopyridines, etc.; the foregoing heterocyclic mercapto compounds further containing a water-soluble group, e.g., a carboxy group or a sulfo group, etc.; thioketo compounds such as oxazolinethione, etc.; azaindenes such as tetraazaindenes (particularly 4-hydroxy-substituted (1,3,3a,7)tetraazaindenes), etc.; benzenethiosulfonic acids; benzene sulfinic acid, and so on.

The photographic emulsion used in the present invention can also be spectrally sensitized with methine dyes or other dyes, such as cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventional nuclei for cyanine dyes may be used in these dyes as basic heterocyclic nuclei, including, e.g., a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus in addition to nuclei formed by condensing alicyclic hydrocarbon rings with these nuclei and nuclei formed by condensing aromatic hydrocarbon rings with these nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. The carbon atoms of these nuclei can also be substituted.

The merocyanine dyes and the complex merocyanine dyes that can be employed contain 5- or 6-membered heterocyclic nuclei such as a pyrazolin-5-one nucleus, a thiohydantoin nucleus, a 2-thioxazolidin-2,4-dione nucleus, a thiazolidine-2,4-dione nucleus, a rhodanine nucleus or a thiobarbituric acid nucleus.

These sensitizing dyes can be employed individually, and can also be employed in combination. A combination of sensitizing dyes is often used particularly for the purpose of supersensitization, and representative examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

The sensitizing dyes may be present in the emulsion together with dyes which themselves do not have spectrally sensitizing effects but which exhibit a supersensitizing effect, or materials which do not substantially absorb visible light but which exhibit a supersensitizing effect. For example, aminostilbene compounds substituted with a nitrogen-containing heterocyclic ring group (e.g., those described in U.S. Pat. Nos. 2,933,390 and 3,635,721), aromatic organic acid-formaldehyde condensates (e.g., those described in U.S. Pat. No. 3,743,510), cadmium salts and azaindene compounds can be used. The combinations described in U.S. Pat. Nos. 3,615,613, 3,615,641, 3,617,295 and 3,635,721 are particularly useful.

The present invention is also applicable to a multilayer multicolor photographic material containing layers sensitive to at least two different spectral wavelength ranges on a support. A multilayer natural color photographic material generally possesses at least one red-sensitive silver halide emulsion layer, at least one green-sensitive silver halide emulsion layer and at least one blue-sensitive silver halide emulsion layer on a support. The order of these layers can be varied, if desired. Ordinarily, a cyan forming coupler is present in a red-sensitive emulsion layer, a magenta forming coupler is present in a green-sensitive emulsion layer and a yellow forming coupler is present in a blue-sensitive emulsion layer, although if desired, a different combination can be employed.

The usual non-diffusible type dye-forming couplers which can be used in combination with the smearing dye-producing couplers of the present invention are couplers that develop color and form a non-diffusible dye on reacting with an oxidation product of a color-forming developing agent. Non-diffusible couplers having a hydrophobic group called a ballast group in the molecule or polymerized couplers are preferably used. The couplers may be four-equivalent or two-equivalent relative to silver ions. Colored couplers exhibiting a color correction effect, or couplers releasing a development inhibitor as development proceeds (so-called DIR couplers) may be incorporated. Colorless DIR coupling compounds which provide a colorless coupling reaction product and release a development inhibitor may be incorporated. For example, as magenta couplers, a 5-pyrazolone coupler, a pyrazolobenzimidazole coupler, a cyanoacetylcoumarone coupler, and an open-chain acylacetonitrile coupler can be used; as yellow couplers, an acylacetamide coupler (e.g., benzoylacetoanilides and pivaloylacetoanilides) can be used; and as cyan couplers, a naphthol coupler and a phenol coupler can be used.

Photographic color formers to be used are selected to provide images of intermediate scale. It is preferred that the maximum absorption band of cyan dye formed from a cyan color former be between about 600 and 720 nm; the maximum absorption band of magenta dye formed from a magenta color former, between about 500 and 580 nm; and the maximum absorption band of yellow dye formed from a yellow color former, between about 400 and 480 nm.

In order to incorporate the dye diffusible type couplers according to the present invention into a silver halide emulsion layer, known methods, for example, the method as described in U.S. Pat. No. 2,322,027, etc. can be used. For example, the coupler is dissolved in organic solvents having a high boiling point, for example, phthalic acid alkyl esters (e.g., dibutyl phthalate, dioctyl phthalate, etc.), phosphoric acid esters (e.g., diphenyl phosphate, triphenyl phosphate, tricresyl phosphate, dioctylbutyl phosphate, etc.), citric acid esters (e.g., tributyl acetylcitrate, etc.), benzoic acid esters (e.g., octyl benzoate, etc.), alkylamides (e.g., diethyllaurylamide, etc.), fatty acid esters (e.g., dibutoxyethyl succinate, diethyl azelate, etc.), trimesic acid esters (e.g., tributyl trimesate, etc.), or organic solvents having a boiling point of form about 30° to about 150° C., for example, lower alkyl acetates such as ethyl acetate and butyl acetate, ethyl propionate, etc., sec-butyl alcohol, methyl isobutyl ketone, $\beta$-ethoxyethyl acetate, methyl cellosolve acetate, etc., and, thereafter, is dispersed in a hydrophilic colloid. The above-described organic solvents having a high boiling point and organic solvents having a low boiling point may be used in combination with each other.

When the couplers contain an acid group, e.g., a carboxyl group, a sulfonyl group, etc., they are incorporated into a hydrophilic colloid in the form of an aqueous alkaline solution.

Organic solvents having a high boiling point which can be used are described in, for example, U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1031/72, British Pat. No. 1,222,753, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,676,142, 3,700,454, 3,748,141 and 3,837,863, West German Pat. (OLS) No. 2,538,889, Japanese Patent Application (OPI) Nos. 27921/76, 27922/76, 26035/76, 26036/76 and 62632/75, Japanese Patent Publication No. 29461/74, U.S. Pat. Nos. 3,936,303 and 3,748,141, Japanese Patent Application (OPI) No. 1521/78, etc. Further, the smearing dye-producing couplers according to the present invention may be incorporated into a silver halide emulsion layer by loading the couplers into a polymer latex using the methods as described in Japanese Patent Application (OPI) Nos. 39853/76, 59942/76 and 32552/79, U.S. Pat. No. 4,199,363, etc. and then adding to the silver halide emulsion.

As a binder or a protective colloid used for emulsion layers or interlayers of the light-sensitive material of the present invention, it is advantageous to use gelatin, although other hydrophilic colloids can be used. For example, proteins, such as gelatin derivatives, graft polymers of gelatin and other polymers, albumin, casein, etc.; cellulose derivatives, such as hydroxyethyl cellulose, carboxymethyl cellulose, cellulose sulfuric acid esters, etc.; saccharide derivatives, such as sodium alginate, starch derivatives, etc.; a wide variety of hydrophilic synthetic homo- or copolymers, such as polyvinyl alcohol, polyvinyl alcohol partial acetal, poly(N-vinyl) pyrrolidone, polyacrylic acid, polymethacrylic acid, polyacrylamide, polyvinyl imidazole, polyvinyl pyrazole, etc. can be used.

In addition to lime-processed gelatin, acid-processed gelatin and enzyme-processed gelatin as described in *Bull. Soc. Sci. Phot. Japan,* No. 16, page 30 (1966) may be used as gelatin. In addition, hydroyzates and enzyme-decomposition products of gelatins can be used. Gelatin derivatives derived by reacting gelatins with acid halides, acid anhydrides, isocyanates, bromoacetic acid, alkanesultones, vinylsulfonamides, maleinimides, polyalkylene oxides and epoxy compounds are also used.

Emulsions may be used in which silver halide grains of a super tabular structure having a diameter of at least about 5 times greater than the thickness account for at least about 50% of the total weight.

In photographic emulsion layers or other hydrophilic colloid layers of the photographic light-sensitive material of the invention can be incorporated various surface active agents as coating aids or for other various purposes, e.g., preventing of charging, improvement of slipping properties, emulsification and dispersion, prevention of adhesion, and improvement of photographic characteristics (particularly development acceleration, increase in gradation, and sensitization).

Surface active agents which can be used include nonionic surface active agents, e.g., saponin (steroid type), alkylene oxide derivatives (e.g., polyethylene glycol, polyethylene glycol/polypropylene glycol condensates, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, silicone/-polyethylene oxide adducts, etc.), glycidol derivatives (e.g., alkenylsuccinic acid polyglyceride alkylphenol polyglyceride, etc.), fatty acid esters of polyhydric alcohols, alkyl esters of sugar, etc., anionic surface active agents containing acidic groups, such as a carboxyl group, a sulfo group, a phospho group, a sulfuric acid ester group, a phosphoric acid ester group, etc., for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, etc.; amphoteric surface active agents, such as amino acids, aminoalkylsulfonic acids, aminoalkylsulfuric acid esters, aminoalkylphosphoric acid esters, alkylbetaines amine oxides, etc.; and cationic surface active agents, e.g., alkylamine salts, aliphatic or aromatic quaternary ammonium salts, heterocyclic quaternary ammonium salts (e.g., pyridinium, imidazolium, etc.), aliphatic or heterocyclic phosphonium or sulfonium salts, etc.

The photographic emulsion layers of the photographic light-sensitive material of the invention may contain compounds such as polyalkylene oxide or its ether, ester, amine or like derivatives, thioether compounds, thiomorpholines, quaternary ammonium salt compounds, urethane derivatives, urea derivatives, imidazole derivatives, 3-pyrazolidones, etc. for the purpose of increasing sensitivity or contrast, or of accelerating development.

In photographic emulsion layers or other hydrophilic colloid layers of the photographic light-sensitive material of the invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc., and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, styrenesulfonic acid, etc.

In photographic processing of layers composed of photographic emulsions in the photographic light-sensitive material of the invention, any of known procedures and known processing solutions, e.g., those described in *Research Disclosure,* Vol. 176, pages 28 to 30 (RD-17643), can be used. This photographic processing may be a photographic processing (color photographic process) to form dye images depending on the purpose. The processing temperature is usually chosen from between 18° C. and 50° C., although it may be lower than 18° C. or higher than 50° C.

Any fixing solutions which are generally used can be used in the present invention. As fixing agents, thiosulfates and thiocyanates, and in addition, organic sulfur compounds which are known effective as fixing agents can be used. These fixing solutions may contain water-soluble aluminum salts as hardeners.

Formation of dye images can be achieved by the usual method. For example, a negative-positive method (described in, for example, *Journal of the Society of Motion Picture and Television Engineers,* Vol. 61, pages 667 to 701 (1953)) can be employed.

Color developing solutions are usually alkaline aqueous solutions containing color developing agents. As color developing agents, known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc., can be used.

In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 64933/73, etc., may be used.

The color developer can further contain pH buffers such as sulfites, carbonates, borates, and phosphates of alkali metals, development inhibitors such as bromides, iodides, and organic antifoggants, antifoggants, and the like. If necessary, hard water-softening agents, preservatives such as hydroxylamines, organic solvents such as benzyl alcohol and diethylene glycol, development accelerators such as polyethylene glycol, quaternary ammonium salts, and amines, dye-forming couplers, competing couplers, fogging agents such as sodium boronhydride, auxiliary developing agents such as 1-phenyl-3-pyrazolidone, tackifiers, polycarboxlic acid-based chelating agents as described in U.S. Pat. No. 4,083,723, antioxidants as described in West German Patent Application (OLS) No. 2,622,950, and the like may be added.

After the color development, the photographic emulsion layer is usually bleached. This bleaching process may be performed simultaneously with a fixing process or they may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates; organic complex salts of iron (III) or cobalt (III), e.g., complex salts of organic acids, such as aminopolycarboxylic acids (e.g., ethylenediaminetetraacetic acid, nitrilotriacetic acid, 1,3-diamino-2-propanoletraacetic acid, etc.) or organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a monobath bleach-fixing solution.

In photographic processing of the light-sensitive material of the present invention, black-and-white photographic processing to form a silver image, or color photographic processing involving a developing step to form a dye image can be used.

The photographic light-sensitive material of the present invention may contain inorganic or organic hardeners in the photographic emulsion layers and other hydrophilic colloid layers thereof. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) can be used alone or in combination with each other.

In the photographic light-sensitive material of the present invention, when dyes, ultraviolet ray absorbers, and the like are incorporated in the hydrophilic colloid layers, they may be mordanted with cationic polymers, etc. For this purpose, the polymers are described in, for example, British Pat. No. 685,475, U.S. Pat. Nos. 2,675,316, 2,839,401, 2,882,156, 3,048,487, 3,184,309 and 3,445,231, West German Patent Application (OLS) No. 1,914,362, Japanese Patent Application (OPI) Nos. 47624/75 and 71332/75, etc. can be used.

The photographic light-sensitive material of the present invention may contain therein hydroquinone derivatives, aminophenol derivatives, gallic acid derivatives, ascorbic acid derivatives, etc., as color fog preventing agents. Representative examples are described in U.S. Pat. Nos. 2,360,290, 2,336,327, 2,403,721, 2,418,613, 2,675,314, 2,701,197, 2,704,713, 2,728,659, 2,732,300, 2,735,765, Japanese Patent Application (OPI) Nos. 92988/75, 92989/75, 93928/75, 110337/75, 146235/77, and Japanese Patent Publication No. 23813/75.

In the light-sensitive material of the present invention, the hydrophilic colloid layer may contain ultraviolet absorbers. For example, benzotriazole compounds substituted by an aryl group (described in U.S. Pat. No. 3,533,794, for example), 4-thiazolidone compounds (described in U.S. Pat. Nos. 3,314,794 and 3,352,681, for example), benzophenone compounds (described in Japanese Patent Application (OPI) No. 2784/71), cinnamic acid ester compounds (described in U.S. Pat. Nos. 3,705,805 and 3,707,375, for example), butadiene compounds (described in U.S. Pat. No. 4,045,229), and benzoxidole compounds (described in U.S. Pat. No. 3,700,455, for example) can be used. In addition, compounds described in U.S. Pat. No. 3,499,762 and Japanese Patent Application (OPI) No. 48535/79 can be used. Ultraviolet ray-absorbing couplers (e.g., α-naphthol-based cyan dye-forming couplers) and ultraviolet ray-absorbing polymers may be used. These ultraviolet absorbers may be mordanted to a specific layer.

The photographic light-sensitive material of the present invention may contain water-soluble dyes in the hydrophilic colloid layers thereof as filter dyes or for various purposes, e.g., irradiation prevention, etc. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

In the present invention, known fading preventing agents as described hereinafter can be used in combination. Color image stabilizers as used herein can be used alone or in combination with each other. Typical known fading preventing agents include hydroquinone derivatives, gallic acid derivatives, p-alkoxyphenols, p-oxyphenol derivatives, bisphenols, etc.

The invention is described in greater detail with reference to the following examples, which are not to be construed as limiting the scope of the invention. Unless otherwise indicated, all parts, percents and ratios are by weight.

EXAMPLE 1

Silver halide emulsions A (a comparative example) and B (a high iodine content emulsion of the present invention) were prepared as follows.

To 1,000 ml of a 2% aqueous gelatin solution containing 0.41 mol of potassium bromide and 0.06 mol of potassium iodide was added 800 ml of an aqueous solution containing 0.33 mol of silver nitrate over 20 minutes while stirring at 60° C., and the resulting mixture was subjected to physical ripening for 20 minutes. Then, 1,000 ml of an aqueous solution containing 0.67 mol of silver nitrate and an aqueous solution of potassium bromide (0.67 mol/l) were added at the same time over 50 minutes. During this time, pAg was maintained at 8.6. After desalting, $2\times10^{-5}$ mol of sodium thiosulfate and $4\times10^{-4}$ mol of chloroauric acid were added, and chemical sensitization was carried out at 60° C. for 60 minutes, to obtain a silver iodobromide emulsion containing 6 mol% of silver iodide grains of 1.1 μm in average size. This emulsion is referred to as "Emulsion A".

A 2% aqueous solution of gelatin containing 0.37 mol of potassium bromide and 0.10 mol of potassium iodide was prepared, and a silver iodobromide emulsion containing 10 mol% of silver iodide grains of 1.0 μm in average size was prepared in almost the same manner as in Emulsion A. This emulsion is preferred to as "Emulsion B".

On a triacetyl cellulose film support provided with a subbing layer were coated an emulsion layer and a protective layer, the emulsion layer containing Emulsion A or B and a coupler, Coupler Cp-1, or Coupler C-8, C-2 or C-5 (of the present invention) all dissolved and dispersed in tricresyl phosphate, in the combinations shown in Table 1 to prepare Samples 101 to 110 of a light-sensitive material.

The amount of each substance coated is shown in terms of g/m² or mol/m².

| | |
|---|---|
| (1) Emulsion Layer | |
| Negative type silver iodobromide emulsion (calculated as silver) | $1.4\times10^{-2}$ mol/m² |
| Coupler | $8.0\times10^{-4}$ mol/m² |
| Tricresyl phosphate: | 1.1 g/m² |
| Gelatin: | 2.3 g/m² |
| (2) Protective Layer | |
| Sodium 2,4-dichloro-6-hydroxy-s-triazine: | 0.8 g |
| Gelatin: | 1.8 g/m² |

Each sample was subjected to sensitometry exposure and then color developed. Each processed sample was measured for density using a red filter, and the results are shown in Table 1.

Photographic processing was performed at 38° C. under the following conditions:

| | |
|---|---|
| 1. Color Development | 2 min. 45 sec. |
| 2. Bleaching | 6 min. 30 sec. |
| 3. Water Washing | 3 min. 15 sec. |
| 4. Fixing | 6 min. 30 sec. |
| 5. Water Washing | 3 min. 15 sec. |
| 6. Stabilizing | 3 min. 15 sec. |

The processing solutions used above had the following compositions:

| | |
|---|---|
| Color Developing Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methylaniline sulfate | 4.5 g |
| Water to make | 1 liter |
| Bleaching Solution: | |
| Ammonium bromide | 160.0 g |
| Aqueous ammonia (28%) | 25.0 ml |
| Sodium iron ethylenediaminetetraacetate | 130 g |
| Glacial acetic acid | 14 ml |
| Water to make | 1 liter |
| Fixing Solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Stabilizing Solution: | |
| Formalin | 8.0 ml |
| Water to make | 1 liter |

TABLE 1

| Sample No. | Emulsion | Coupler | Relative Sensitivity(1) | RMS Value(2) | Visual Graininess(3) |
|---|---|---|---|---|---|
| 101 (Comparative Example) | A | Cp-1 | 100 | 0.025 | 4 |
| 102 (Comparative Example) | A | C-8 | 100 | 0.019 | 5 |
| 103 (Comparative Example) | A | C-2 | 102 | 0.016 | 5 |
| 104 (Comparative Example) | A | C-5 | 95 | 0.014 | 5 |
| 105 (Comparative Example) | B | Cp-1 | 102 | 0.023 | 4 |
| 105 (Example of the Invention) | B | C-8 | 105 | 0.018 | 2 |
| 106 (Example of the Invention) | B | C-2 | 102 | 0.015 | 1 |
| 107 (Example of the Invention) | B | C-5 | 100 | 0.014 | 2 |

Note:
(1)The relative sensitivity is the reciprocal of the exposure amount providing a density of fog + 0.2, based on the sensitivity of Sample 101 as 100.
(2)The RMS is a value determined at a density of 0.7 for an aperture of 48 μm in diameter.
(3)The visual graininess is determined by examining a processed sample under an optical microscope (× 40) and numerically rated. As the number increases, the graininess also increases.

Graininess was measured by the usual RMS method. The aperture used for the measurement was 48μ. The visual graininess was determined by examining a processed sample under an optical microscope. The results are shown in Table 1.

It has been seen that Table 1 that the samples using the smearing dye-producing couplers, C-8, C-2 and C-5, are all improved in RMS graininess over the sample using coupler Cp-1, but that the Samples 102, 103 and 104 using Emulsion A in which the silver iodide content is 6 mol% have a somewhat deteriorated visual graininess. On the other hand, it can be seen that the Samples 106, 107 and 108 using Emulsion B of high iodine content and smearing dye-producing couplers are markedly improved not only in RMS value but also in visual graininess.

The comparative coupler, Cp-1, used in this example is represented by the following formula.

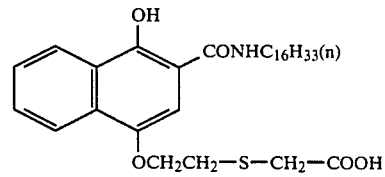

Cp-1

EXAMPLE 2

Emulsion C (a comparative example) and Emulsions D and E (high iodine content silver halide emulsions of the present invention) were prepared as follows.

To 1,000 ml of a 2% aqueous gelatin solution containing 0.41 mol of potassium bromide and 0.06 mol of potassium iodide was added 800 ml of an aqueous solution containing 0.33 mol of siliver nitrate over 50 minutes while stirring at 80° C., and the resulting mixture was subjected to physical ripening for 20 minutes. Then, 1,000 ml of an aqueous solution containing 0.67 mol of silver nitrate and an queous solution of potassium bromide (0.67 mol/l) were added at the same time over 100 minutes. During this time, pAg was maintained at 8.6. After desalting, $1\times10^{-5}$ mol of sodium thiosulfate and $2\times10^{-5}$ mol of chloroauric acid were added, and chemical sensitization was conducted at 60° C. for 60 minutes, to obtain a silver iodobromide emulsion containing 6 mol% of silver iodide grains of 2.1 μm in average size (Emulsion C).

A 2% aqueous gelatin solution containing 0.37 mol of potassium bromide and 0.10 mol of potassium iodide was prepared, and a silver iodobromide emulsion (Emulsion D) containing 10 mol% of silver iodide grains of 2.0 μm in average size was produced in nearly the same manner as in Emulsion C.

A 2% aqueous gelatin solution containing 0.33 mol of potassium bromide and 0.14 mol of potassium iodide was prepared, and a silver iodobromide emulsion (Emulsion E) containing 14 mol% of silver iodide grains of 2.1 μm in average size was produced in nearly the same manner as in Emulsion C.

Multi-layer color photographic light-sensitive materials (Samples 201 to 206) each layer having a composition as shown below were produced using a cellulose acetate film support. These materials were the same with the exception that the combination of an emulsion and a coupler as used in the 9th layer was varied as shown in Table 2. The amount of the emulsion coated is expressed in terms of the amount of silver coated.

Each material was subjected to exposure for sensitometry and then processed in the same manner as in Example 1 except that the time for color development was changed to 3.25 minutes. The RMS value and visual graininess were evaluated in the same manner as in Example 1.

The results are shown in Table 2.

| | |
|---|---|
| 1st Layer: | |
| Antihalation Layer | |
| Gelatin layer containing: | |
| Black colloidal silver | 0.18 g/m$^2$ |
| Ultraviolet absorber $C_A$-1 | 0.12 g/m$^2$ |
| Ultraviolet absorber $C_A$-2 | 0.17 g/m$^2$ |
| 2nd Layer: | |
| Interlayer | |
| Gelatin layer containing: | |
| 2,5-di-tert-Pentadecyl hydroquinone | 0.18 g/m$^2$ |
| Coupler $C_A$-3 | 0.11 g/m$^2$ |
| Silver iodobromide emulsion (silver iodide: 1 mol %; average grain size: 0.07 μm) | 0.15 g/m$^2$ |
| 3rd Layer: | |
| First Red-Sensitive Emulsion Layer | |
| Gelatin layer containing: | |
| Silver iodobromide emulsion (silver iodide: 6 mol %; average grain size: 0.6 μm) | 1.20 g/m$^2$ |
| Sensitizing Dye I | $7.0 \times 10^{-5}$ mol per mol of silver |
| Sensitizing Dye II | $2.0 \times 10^{-5}$ mol per mol of silver |
| Sensitizing Dye III | $2.8 \times 10^{-4}$ mol per mol of silver |
| Sensitizing Dye IV | $2.0 \times 10^{-5}$ mol per mol of silver |
| Coupler $C_A$-4 | 0.093 g/m$^2$ |
| Coupler $C_A$-5 | 0.31 g/m$^2$ |
| Coupler $C_A$-6 | 0.010 g/m$^2$ |
| 4th Layer: | |
| Second Red-Sensitive Emulsion Layer | |
| Gelatin layer containing: | |
| Silver iodobromide emulsion (silver iodide: 10 mol %; average grain size: 1.5 μm) | 1.2 g/m$^2$ |
| Sensitizing Dye I | $5.2 \times 10^{-5}$ mol per mol of silver |
| Sensitizing Dye II | $1.5 \times 10^{-5}$ mol per mol of silver |
| Sensitizing Dye III | $2.1 \times 10^{-4}$ mol per mol of silver |
| Sensitizing Dye IV | $1.5 \times 10^{-5}$ mol per mol of silver |
| Coupler $C_A$-4 | 0.10 g/m$^2$ |
| Coupler $C_A$-5 | 0.061 g/m$^2$ |
| Coupler $C_A$-7 | 0.046 g/m$^2$ |
| 5th Layer: | |
| Third Red-Sensitive Emulsion Layer | |
| Gelatin layer containing: | |
| Silver iodobromide emulsion (silver iodide: 10 mol %; average grain size: 2.2 μm) | 1.5 g/m$^2$ |
| Sensitizing Dye I | $5.5 \times 10^{-5}$ mol per mol of silver |
| Sensitizing Dye II | $1.6 \times 10^{-5}$ mol per mol of silver |
| Sensitizing Dye III | $2.2 \times 10^{-5}$ mol per mol of silver |
| Sensitizing Dye IV | $1.6 \times 10^{-5}$ mol per mol of silver |
| Coupler $C_A$-5 | 0.0.44 g/m$^2$ |
| Coupler $C_A$-7 | 0.16 g/m$^2$ |
| 6th Layer: | |
| Interlayer | |
| Gelatin layer | |
| 7th Layer: | |
| First Green-Sensitive Emulsion Layer | |
| Gelatin layer containing: | |
| Silver iodobromide emulsion (silver iodide: 5 mol %; average grain size 0.5 μm) | 1.0 g/m$^2$ |
| Sensitizing Dye V | $3.8 \times 10^{-4}$ mol per mol of silver |

-continued

| | |
|---|---|
| Sensitizing Dye VI | $3.0 \times 10^{-5}$ mol per mol of silver |
| Sensitizing Dye VIII | $1.2 \times 10^{-4}$ mol per mol of silver |
| Coupler $C_A$-8 | 0.29 g/m$^2$ |
| Coupler $C_A$-9 | 0.040 g/m$^2$ |
| Coupler $C_A$-10 | 0.055 g/m$^2$ |
| Coupler $C_A$-11 | 0.058 g/m$^2$ |
| 8th Layer: | |
| Second Green-Sensitive Emulsion Layer | |
| Gelatin layer containing: | |
| Silver iodobromide emulsion (silver iodide: 8 mol %; average grain size: 1.5 μm) | 1.0 g/m$^2$ |
| Sensitizing Dye V | $2.7 \times 10^{-4}$ mol per mol of silver |
| Sensitizing Dye VI | $2.1 \times 10^{-5}$ mol per mol of silver |
| Sensitizing Dye VII | $8.5 \times 10^{-5}$ mol per mol of silver |
| Coupler $C_A$-8 | 0.25 g/m$^2$ |
| Coupler $C_A$-9 | 0.013 g/m$^2$ |
| Coupler $C_A$-10 | 0.009 g/m$^2$ |
| Coupler $C_A$-11 | 0.011 g/m$^2$ |
| 9th Layer: | |
| Third Green-Sensitive Emulsion Layer | |
| Gelatin layer containing: | |
| Emulsion C, D or E | 1.5 g/m$^2$ |
| Sensitizing Dye V | $3.0 \times 10^{-4}$ mol per mol of silver |
| Sensitizing Dye VI | $2.4 \times 10^{-5}$ mol per mol of silver |
| Sensitizing Dye VII | $9.5 \times 10^{-4}$ mol per mol of silver |
| Coupler $C_A$-12 or M-25 | 0.070 g/m$^2$ |
| Coupler $C_A$-9 | 0.013 g/m$^2$ |
| 10th Layer: | |
| Yellow Filter Layer | |
| Gelatin layer containing: | |
| Yellow colloidal silver | 0.04 g/m$^2$ |
| 2,5-di-tert-Pentadecyl hydroquinone | 0.031 g/m$^2$ |
| 11th Layer: | |
| First Blue-Sensitive Emulsion Layer | |
| Gelatin layer containing: | |
| Silver iodobromide emulsion (silver iodide: 6 mol %; average grain size: 0.4 μm) | 0.50 g/m$^2$ |
| Coupler $C_A$-13 | 0.68 g/m$^2$ |
| Coupler $C_A$-14 | 0.030 g/m$^2$ |
| 12th Layer: | |
| Second Blue-Sensitive Emulsion Layer | |
| Gelatin layer containing: | |
| Silver iodobromide emulsion (silver iodide: 10 mol %; average grain size: 1.0 μm) | 0.299 g/m$^2$ |
| Coupler $C_A$-13 | 0.22 g/m$^2$ |
| Sensitizing Dye VIII | $2.2 \times 10^{-4}$ mol per mol of silver |
| 13th Layer: | |
| Finely Divided Grain Emulsion Layer | |
| Gelatin layer containing: | |
| Silver iodobromide emulsion (silver iodide: 2 mol %; average grain size: 0.15 μm) | 0.030 g/m$^2$ |
| 14th Layer: | |
| Third Blue-Sensitive Emulsion Layer | |
| Gelatin layer containing: | |
| Silver iodobromide emulsion (silver iodide: 14 mol %; average grain size: 2.3 μm) | 1.00 g/m$^2$ |
| Coupler $C_A$-13 | 0.198 g/m$^2$ |
| Coupler $C_A$-15 | 0.004 g/m$^2$ |
| Sensitizing Dye VIII | $2.3 \times 10^{-4}$ mol per mol of silver |
| 15th Layer: | |
| First Protective Layer | |
| Gelatin layer containing: | |
| Ultraviolet absorber $C_A$-1 | 0.14 g/m$^2$ |
| Ultraviolet absorber $C_A$-2 | 0.22 g/m$^2$ |
| 16th Layer: | |

-continued

| | |
|---|---|
| Second Protective Layer | |
| Gelatin layer containing: | |
| Polymethyl methacrylate grains (diameter: 1.5 μm) | 0.05 g/m$^2$ |
| Silver iodobromide emulsion (silver iodide: 2 mol %; average grain size: 0.07 μm) | 0.10 g/m$^2$ |

Each layer was further coated with gelatin hardening agent C-16 and a surfactant.

TABLE 2

| Sample No. | Emulsion | Coupler | Relative Sensitivity(1) | RMS Value(2) | Visual Graininess(3) |
|---|---|---|---|---|---|
| 201 (Comparative Example) | C | $C_A$-12 | 100 | 0.042 | 4 |
| 202 (Comparative Example) | D | $C_A$-12 | 95 | 0.041 | 4 |
| 203 (Comparative Example) | E | $C_A$-12 | 95 | 0.038 | 3 |
| 204 (Comparative Example) | C | M-25 | 108 | 0.036 | 5 |
| 205 (Example of the Invention) | D | M-25 | 102 | 0.034 | 2 |
| 206 (Example of the Invention) | E | M-25 | 102 | 0.031 | 1 |

Note:
(1)The relative sensitivity is the reciprocal of the exposure amount providing a density of fog +0.2, based on the sensitivity of Sample 201 as 100.
(2)The RMS value is a value determined at a density of 0.8 for an aperture of 48 μm in diameter.
(3)Same as defined in Table 1.

It can be seen from Table 2 that Samples 205 and 206 of the present invention are improved in both RMS graininess and visual graininess over Sample 204 in which a dye diffusible type coupler alone is used, and over Samples 202 and 203 in which a high iodine content emulsion alone is used. This demonstrates that the combination of a high iodine content silver halide emulsion and a smearing dye-producing coupler according to the present invention is effective in specifically improving visual graininess.

The compounds used in this example have the following chemical structures:

Polymer having the following repeating units.

$C_A$-1

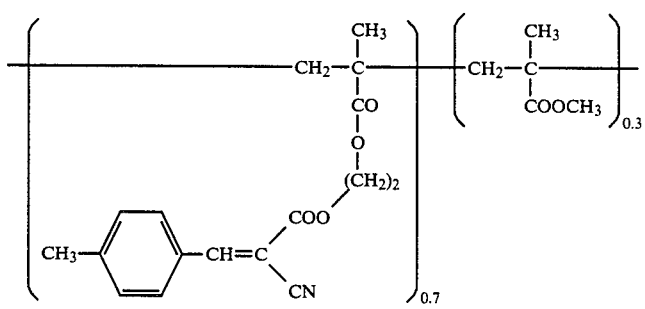

$C_A$-2

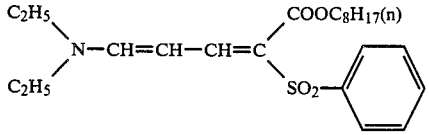

$C_A$-3

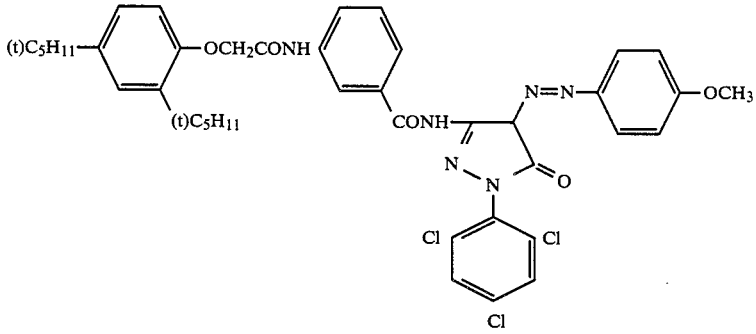

$C_A$-4

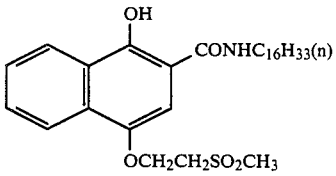

-continued
$C_A$-5
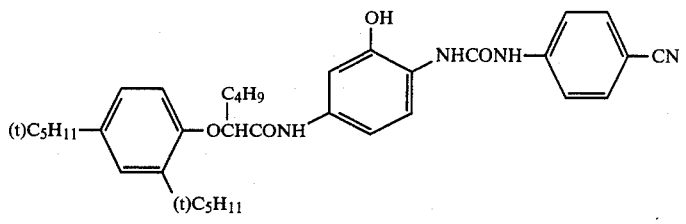
$C_A$-6
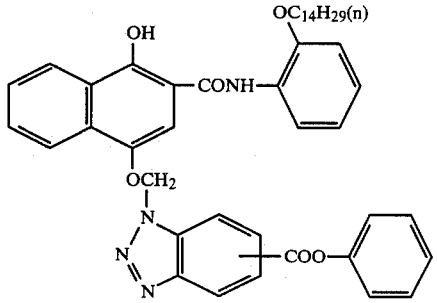
$C_A$-7
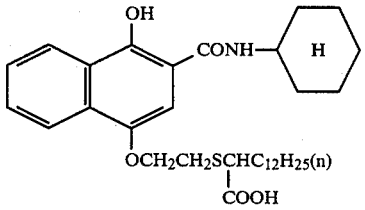
$C_A$-8
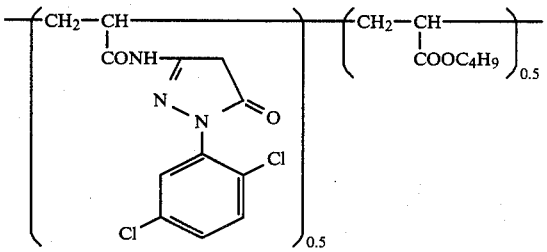
$C_A$-9
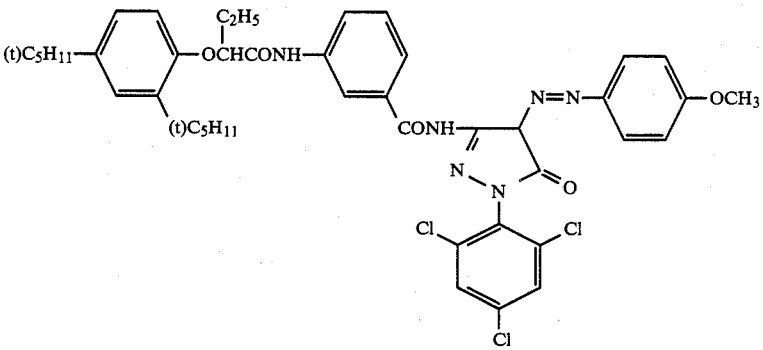

-continued
$C_A$-10
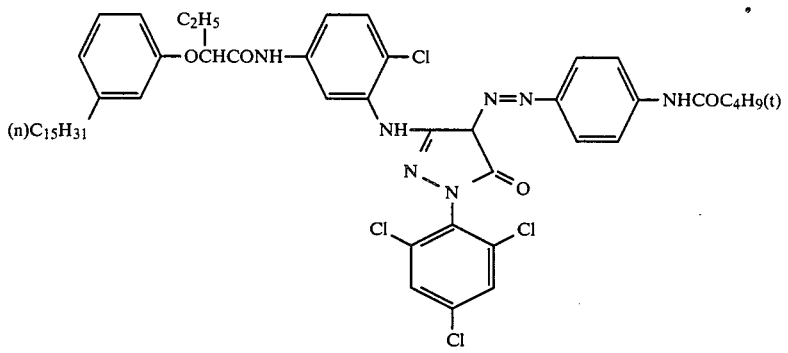
$C_A$-11
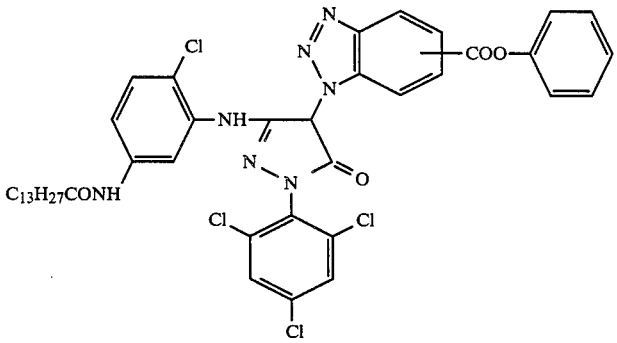
$C_A$-12
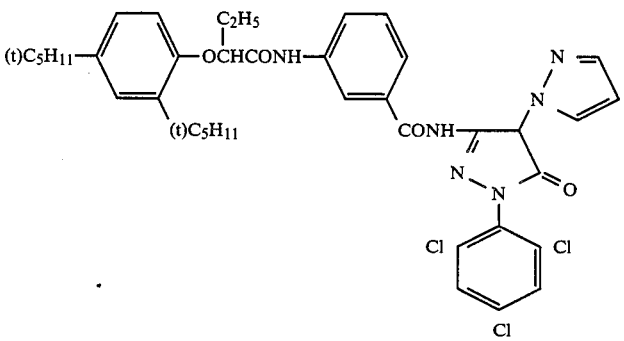
$C_A$-13
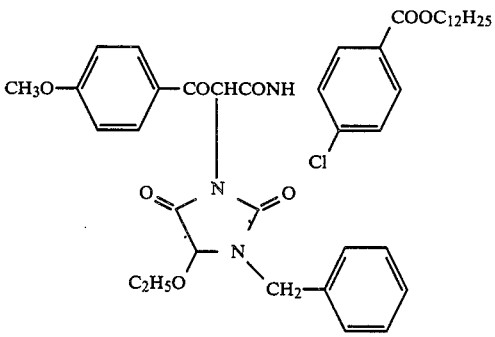

-continued
$C_A$-14
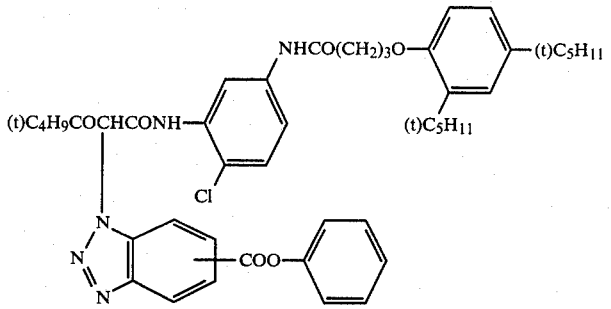
$C_A$-15
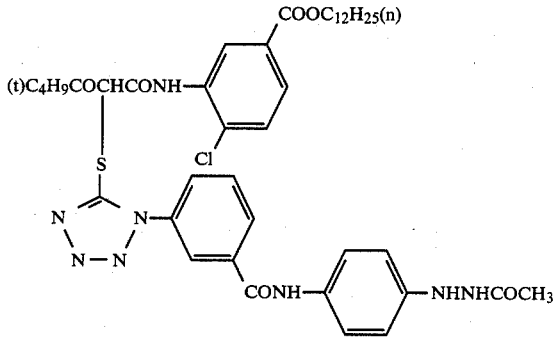
C-16
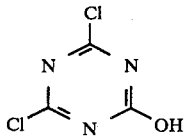
Sensitizing Dyes
I
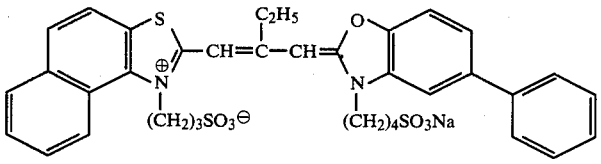
II
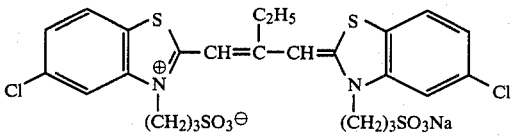
III
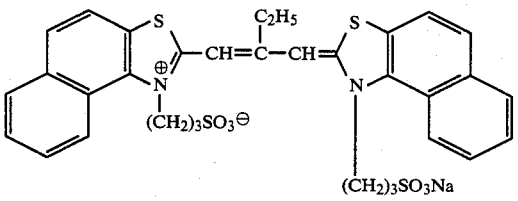
IV
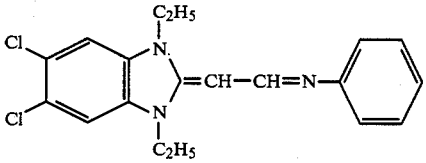

-continued

V

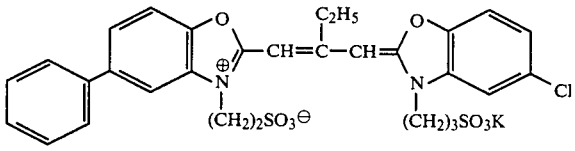

VI

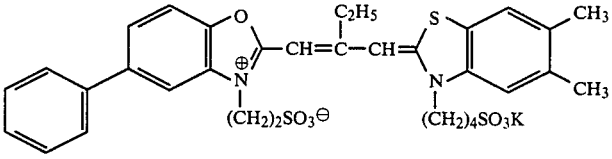

VII

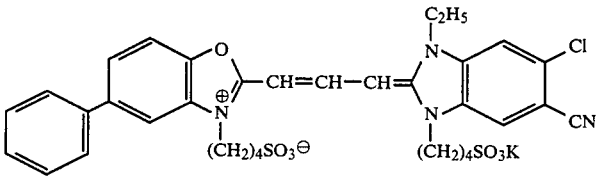

VIII

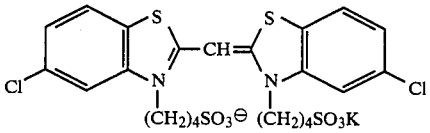

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon at least one silver halide emulsion layer, wherein the photographic light-sensitive material has a layer containing both a non-diffusible coupler capable of producing a dye of such mobility that controlled image smearing occurs upon reaction with the oxidation product of a color developing agent and a silver halide emulsion in which silver halide grains containing at least 10 mol% of silver iodide grains account for at least about 40% by weight of the total silver halide grains in the emulsion; wherein the non-diffusible coupler is a coupler represented by the following general formula (A):

$$(Cp)_a X \qquad (A)$$

wherein Cp represents a coupler component which yields a dye of such mobility that controlled image smearing occurs and improves graininess; X represents a component which is bonded to the coupling position of the coupler component, which is released upon a reaction with the oxidation product of a color developing agent and which contains a ballast group having from 8 to 32 carbon atoms and a represents 1 to 2; and the non-diffusible coupler represented by the formula (A) is a coupler represented by the following general formula (XV) or (XVI):

(XV)

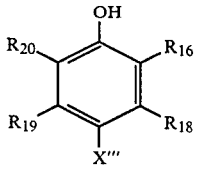

(XVI)

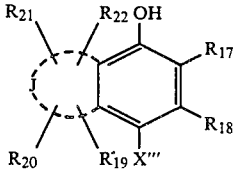

where $R_{16}$ represents a hydrogen atom, an aliphatic group having 10 or less carbon atoms, an alkoxy group having 10 or less carbon atoms, an aryloxy group, an acylamido group, a sulfonamido group and a ureido group represented by the general formulae (XVII) to (XIX) as described below, or a carbamoyl group represented by the general formula (XX) as described below:

$$-NH-CO-G \qquad (XVII)$$

$$-NH-SO_2-G \qquad (XVIII)$$

$$-NHCONH-G \qquad (XIX)$$

(XX)

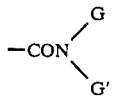

wherein G and G', which may be the same or different, each represents a hydrogen atom, provided that G and G' are not hydrogen atoms at the same time and that the total number of carbon atoms included in G and G′ is form 1 to 12, an aliphatic group having from 1 to 12 carbon atoms, an aryl group or a heterocyclic group, and each of these groups may be substituted with a halogen atom, a nitro group, a cyano group, a hydroxy group, a carboxy group, an amino group, an alkyl group, an aryl group, an alkoxycarbonyl group, an acyloxycarbonyl group, an amido group, an imido group, a carbamoyl group, a sulfamoyl group, an alkoxy group, an aryloxy group or a sulfonyl group; $R_{17}$ represents a hydrogen atom, an aliphatic group having 12 or less carbon atoms or a carbamoyl group represented by the general formula (XX), $R_{18}$, $R_{19}$, $R_{20}$, $R_{21}$ and $R_{22}$ each represents a hydrogen atom, a halogen atom, an alkyl group, an aryl group, an alkoxy group, an alkylthio group, a heterocyclic group, an amino group, a carbonamido group, a sulfonamido group, a sulfamonyl group or a carbamoyl group; J represents a non-metal atomic group necessary to form a 5-membered or 6-membered ring; and X‴ represents a group which contains a group having from 8 to 32 carbon atoms, which is bonded to the coupling position through —O, —S, or —N=N, and which is capable of being released upon a coupling reaction with an oxidation product of an aromatic primary amine developing agent.

2. A silver halide color photographic light-sensitive material as claimed in claim 1, wherein the non-diffusible coupler is present in an amount within the range of about $1\times10^{-3}$ to $1\times10^{-1}$ mol per mol of silver halide.

3. A silver halide color photographic light-sensitive material as claimed in claim 2, wherein the non-diffusible coupler is present in an amount within the range of about $3\times10^{-3}$ to $1\times10^{-1}$ mol per mol of silver halide.

4. A silver halide color photographic light-sensitive material as claimed in claim 1, wherein the group represented by X‴ is an alkoxy group, an aryloxy group, an alkylthio group or an arylthio group, each having from 8 to 32 carbon atoms.

5. A silver halide color photographic light-sensitive material as claimed in claim 1, wherein said silver halide grains containing at least 10 mol% of silver iodide grains account for at least about 60% by weight of the total silver halide grains in the emulsion.

6. A silver halide color photographic light-sensitive material claimed in claim 5, wherein said silver halide grains containing at least 10 mol% of silver iodide grains account for at least about 80% by weight of the total silver halide grains in the emulsion.

7. A silver halide color photographic light-sensitive material claimed in claim 1, wherein said silver halide emulsion has an iodine content of from 10 to 40 mol%.

8. A silver halide color photographic light-sensitive material claimed in claim 7, wherein said silver halide emulsion has an iodine content of from 10 to 30 mol%.

9. A silver halide color photographic light-sensitive material claimed in claim 8, wherein said silver halide emulsion has an iodine content of from 12 to 25 mol%.

10. A silver halide color photographic light-sensitive material claimed in claim 1, wherein said silver halide emulsion contains core/shell silver halide grains having a core comprising at least 15% silver iodide and a shell comprising less than 5% silver iodide.

11. A silver halide color photographic light-sensitive material as claimed in claim 1, wherein the photographic light-sensitive material has at least one red-sensitive silver halide emulsion layer containing a cyan color forming coupler, at least one green-sensitive silver halide emulsion layer containing a magenta color forming coupler and at least one blue-sensitive silver halide emulsion layer containing a yellow color forming coupler, and at least one of these silver halide emulsion layers contains both the non-diffusible coupler and the silver halide emulsion.

12. A method of forming a color image comprising developing an imagewise exposed silver halide color photographic light-sensitive material comprising a support having thereon at least one silver halide emulsion layer, wherein the photographic light-sensitive material has a layer containing both a non-diffusible coupler capable of producing a dye of such mobility that controlled image smearing occurs upon reaction with the oxidation product of a color developing agent and a silver halide emulsion in which silver halide grains containing at least 10 mol% of silver iodide grains account for at least about 40% by weight of the total silver halide grains in the emulsion with an aqueous alkaline solution containing a color developing agent; wherein the non-diffusible coupler is a coupler represented by the following general formula (A):

$$(Cp)_{\overline{a}}X \qquad (A)$$

wherein Cp represents a coupler component which yields a dye of such mobility that controlled image smearing occurs and improves graininess; X represents a component which is bonded to the coupling position of the coupler component, which is released upon a reaction with the oxidation product of a color developing agent and which contains a ballast group having from 8 to 32 carbon atoms; and a represents 1 or 2; and the non-diffusible coupler represented by the formula (a) is a coupler represented by the following general formulae (XV) or (XVI)

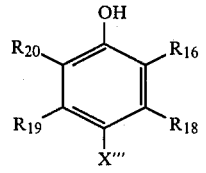

(XV)

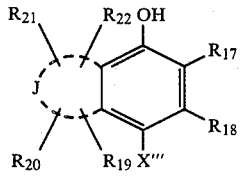

(XVI)

wherein $R_{16}$ represents a hydrogen atom, an aliphatic group having 10 or less carbon atoms, an alkoxy group having 10 or less carbon atoms, an aryloxy group, an acylamido group, a sulfonamido group and a ureido group represented by the general formulae (XVII) to (XIX) as described below, or a carbamoyl group represented by the general formula (XX) as described below:

$$-NH-CO-G \qquad (XVII)$$

$$-NH-SO_2-G \qquad (XVIII)$$

$$-NHCONH-G \qquad (XIX)$$

-continued

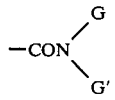

(XX)

wherein G and G′, which may be the same or different, each represents a hydrogen atom, provided that G and G′ are not hydrogen atoms at the same time and that the total number of carbon atoms included in G and G′ is form 1 to 12, an aliphatic group having from 1 to 12 carbon atoms, an aryl group or a heterocyclic group, and each of these groups may be substituted with a halogen atom, a nitro group, a cyano group, a hydroxy group, a carboxy group, an amino group, an alkyl group, an aryl group, an alkoxycarbonyl group, an acyloxycarbonyl group, an amido group, an imido group, a carbamoyl group, a sulfamoyl group, an alkoxy group, an aryloxy group or a sulfonyl group; $R_{17}$ represents a hydrogen atom, an aliphatic group having 12 or less carbon atoms or a carbamoyl group represented by the general formula (XX), $R_{18}$, $R_{19}$, $R_{20}$, $R_{21}$ and $R_{22}$ each represents a hydrogen atom, a halogen atom, an alkyl group, an aryl group, an alkoxy group, an alkylthio group, a heterocyclic group, an amino group, a carbonamido group, a sulfonamido group, a sulfamoyl group or a carbamoyl group; J represents a non-metal atomic group necessary to form a 5-membered or 6-membered ring; and X‴ represents a group which contains a group having from 8 to 32 carbon atoms, which is bonded to the coupling position through —O—, —S—, or —N=N—, and which is capable of being released upon a coupling reaction with an oxidation product of an aromatic primary amine developing agent.

* * * * *